US010133198B2

(12) United States Patent
Zhu et al.

(10) Patent No.: US 10,133,198 B2
(45) Date of Patent: Nov. 20, 2018

(54) ELECTROPHOTOGRAPHIC PHOTORECEPTOR, METHOD FOR MANUFACTURING SAME AND ELECTROPHOTOGRAPHIC DEVICE

(71) Applicant: FUJI ELECTRIC CO., LTD., Kawasaki-shi, Kanagawa (JP)

(72) Inventors: Fengqiang Zhu, Matsumoto (JP); Shinjiro Suzuki, Matsumoto (JP); Toshiki Takeuchi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 29 days.

(21) Appl. No.: 15/611,934

(22) Filed: Jun. 2, 2017

(65) Prior Publication Data

US 2017/0269487 A1 Sep. 21, 2017

Related U.S. Application Data

(63) Continuation of application No. PCT/JP2015/066943, filed on Jun. 11, 2015.

(51) Int. Cl.
*G03G 5/00* (2006.01)
*G03G 5/06* (2006.01)
(Continued)

(52) U.S. Cl.
CPC ..... *G03G 5/0609* (2013.01); *B05D 1/02* (2013.01); *B05D 1/18* (2013.01); *G03G 5/047* (2013.01);
(Continued)

(58) Field of Classification Search
CPC ..... G03G 5/147; G03G 5/14708; G03G 5/14756; G03G 5/0609; G03G 5/0564
(Continued)

(56) References Cited

U.S. PATENT DOCUMENTS 4,628,336 A 12/1986 Satake et al.
4,695,649 A 9/1987 Magami et al.
(Continued)

FOREIGN PATENT DOCUMENTS

JP S51-001479 B2 1/1976
JP S57-122444 A 7/1982
(Continued)

*Primary Examiner* — Mark A Chapman
(74) *Attorney, Agent, or Firm* — Rabin & Berdo, P.C.

(57) ABSTRACT

An electrophotographic photoreceptor includes a conductive substrate and a photosensitive layer, wherein an outermost layer contains a compound having a structure represented by general formula (I) below:

(I)

where $R_1$ and $R_2$ each independently represent a $C_{1-12}$ alkyl group or a $C_{5-12}$ cycloalkyl group; $R_3$ represents a hydrogen atom, a halogen atom, a substituted or unsubstituted $C_{1-6}$ alkyl group, a substituted or unsubstituted $C_{1-6}$ alkoxyl group, a $C_{6-20}$ aryl group or a heterocycle group; X and Z each represent a single bond or a $C_{1-6}$ alkylene group which may be substituted; and Y represents a OCO group or COO group. A method for manufacturing the photoreceptor and an electrophotographic device including the photoreceptor are additionally provided. The electrophotographic photoreceptor provides sufficient stain resistance and is less affected by temperature and humidity environments while maintaining various advantageous characteristics of photoreceptors.

10 Claims, 2 Drawing Sheets

(51) Int. Cl.

| | |
|---|---|
| ***G03G 5/147*** | (2006.01) |
| ***G03G 5/047*** | (2006.01) |
| ***G03G 5/05*** | (2006.01) |
| ***B05D 1/02*** | (2006.01) |
| ***B05D 1/18*** | (2006.01) |
| ***G03G 5/043*** | (2006.01) |
| ***G03G 5/087*** | (2006.01) |
| ***G03G 15/00*** | (2006.01) |

(52) U.S. Cl.
CPC ..... *G03G 5/0436* (2013.01); *G03G 5/05* (2013.01); *G03G 5/0517* (2013.01); *G03G 5/0525* (2013.01); *G03G 5/0564* (2013.01); *G03G 5/087* (2013.01); *G03G 5/147* (2013.01); *G03G 5/14708* (2013.01); *G03G 5/14756* (2013.01); *G03G 15/75* (2013.01)

(58) Field of Classification Search
USPC ..... 430/66
See application file for complete search history.

(56) References Cited

U.S. PATENT DOCUMENTS

| | | | |
|---|---|---|---|
| 4,952,470 | A | 8/1990 | Tamaki et al. |
| 5,665,500 | A | 9/1997 | Suzuki |
| 6,030,733 | A | 2/2000 | Kami et al. |
| 6,210,848 | B1 | 4/2001 | Nagai et al. |
| 7,217,483 | B2 | 5/2007 | Nozomi et al. |
| 7,976,447 | B2 | 7/2011 | Urano et al. |
| 8,354,210 | B2 | 1/2013 | Takaki et al. |
| 8,748,069 | B2 | 6/2014 | Zhu et al. |
| 8,765,336 | B2 | 7/2014 | Zhu et al. |
| 2006/0134541 | A1 | 6/2006 | Fujii et al. |

FOREIGN PATENT DOCUMENTS

| | | | |
|---|---|---|---|
| JP | S60-222445 | A | 11/1985 |
| JP | S61-027284 | A | 2/1986 |
| JP | S63-018355 | A | 1/1988 |
| JP | H06-075394 | A | 3/1994 |
| JP | H06-118678 | A | 4/1994 |
| JP | H07-168381 | A | 7/1995 |
| JP | H08-272126 | A | 10/1996 |
| JP | H11-160958 | A | 6/1999 |
| JP | H11-288113 | A | 10/1999 |
| JP | 2001-013708 | A | 1/2001 |
| JP | 2002-287388 | A | 10/2002 |
| JP | 2004-199051 | A | 7/2004 |
| JP | 2004-206109 | A | 7/2004 |
| JP | 2004-226637 | A | 8/2004 |
| JP | 2007-279446 | A | 10/2007 |
| JP | 2008-164757 | A | 7/2008 |
| JP | 2013-004719 | A | 1/2013 |
| JP | 2013-041101 | A | 2/2013 |
| JP | 5429654 | B2 | 2/2014 |
| JP | 5534030 | B2 | 6/2014 |

ELECTROPHOTOGRAPHIC PHOTORECEPTOR, METHOD FOR MANUFACTURING SAME AND ELECTROPHOTOGRAPHIC DEVICE

CROSS-REFERENCE TO RELATED APPLICATION(S)

This non-provisional application for a U.S. patent is a Continuation of International Application PCT/JP2015/066943 filed Jun. 11, 2015, the entire contents of which is hereby incorporated by reference.

BACKGROUND OF THE INVENTION

1. Technical Field

The present invention relates to an electrophotographic photoreceptor (hereinafter also simply referred to as a "photoreceptor") used for electrophotographic printers, copying machines, facsimiles and the like, a method for manufacturing the same and an electrophotographic device, and more specifically, relates to an electrophotographic photoreceptor having excellent stain resistance due to an improvement of an additive and a method for manufacturing the same and an electrophotographic device.

2. Background of the Related Art

Electrophotographic photoreceptors are generally required to have the function of holding a surface charge in a dark place, the function of generating charge by receiving light and the function of transporting charge by similarly receiving light. Such photoreceptors include so-called single layer photoreceptors having a single-layer photosensitive layer having all the functions in one layer, and so-called stacked photoreceptors having a photosensitive layer including a stack of functionally discrete layers: a layer which primarily serves to generate charge; and a layer which serves to hold a surface charge in a dark place and transport the charge during photoreception.

For example, Carlson process is applied for electrophotographic image formation using such electrophotographic photoreceptors. Images are formed according to the process by charging a photoreceptor in a dark place; forming an electrostatic image of an original text or drawing onto the surface of the charged photoreceptor; developing the formed electrostatic image with a toner; and transferring and fixing the developed toner image onto a support such as paper. The photoreceptor after transfer of the toner image is subjected to removal of remaining toner and neutralisation and then re-used.

The materials for the electrophotographic photoreceptors used include inorganic photoconductive materials such as selenium, selenium alloys, zinc oxide and cadmium sulphide dispersed in a resin binder; organic photoconductive materials such as poly-N-vinylcarbazole, 9,10-anthracenediol-polyester, pyrazoline, hydrazone, stilbene, butadiene, benzidine, phthalocyanine or bisazo compounds dispersed in a resin binder; and materials obtained by vacuum deposition or sublimation of the foregoing.

Because of, for example, an increase in printing pages due to networking in offices and rapid development in lightweight electrophotographic printing machines, electrophotographic printing machines are required to have further improved durability and sensitivity as well as fast response. It is also strongly required to have low effect due to gases generated in the devices such as ozone and NOx and low variation of image characteristics due to varied operating environment (temperature and humidity of the room).

However, conventional photoreceptors do not necessarily and satisfactorily fulfil the required demand characteristics and have issues as indicated below.

For example, concerning stain resistance, streaks are generated in halftone images because the surface of the photoreceptor is stained with components exuded from the constituent of rollers such as a charging roller and a transfer roller which are always in contact with the photoreceptor.

Concerning stain resistance, Patent Literature 1, hereinafter "PTL1" (see the listing in the following), proposes a method in which a resistive layer of a charging roller is formed with a resin containing an ethylene-butylene copolymer and Patent Literature 2, hereinafter "PTL2", proposes a method in which a transfer roller is formed with a rubber composition containing an epichlorohydrin rubber as a main rubber component and also containing a filler. However, the methods have not been able to satisfactorily meet the demand in stain resistance.

Concerning variation of characteristics of photoreceptors due to operating environment, a first problem is deterioration of the image characteristics in a low temperature and low humidity environment. Namely, in a low temperature and low humidity environment in general, sensitivity characteristics of photoreceptors are apparently decreased, which reveals degradation of image quality such as a decrease of density of images and deterioration of gradation of halftone images. Image memory may become significant accompanying the degradation of sensitivity characteristics. In a printing process, the image recorded as a latent image in the first revolution of the drum is affected by variation of the potential in the second and later revolution of the drum. As a result, printing may occur in unnecessary places particularly in the case of printing of halftone images. This is the degradation of image quality by the image memories. Particularly in a low temperature and low humidity environment, negative memories are often observed in which light and shade of the printing images are reversed.

Image characteristics may also degrade in a high temperature and high humidity environment. Namely, in a high temperature and high humidity environment in general, mobility of charges in the photosensitive layer is larger than in a normal temperature and normal humidity environment, which may cause image defects including excessive increase of printed density and minute black spots in a wholly white image printing (fogging). The excessive increase of printed density increases toner consumption and destructs minute gradation due to enlarged one dot diameter. In contrast to those seen in a low temperature and low humidity environment, positive memories are often observed in which light and shade of printing images is directly reflected.

The performance degradation due to the temperature and humidity is often caused by absorption and release of moisture in the resin binder in the surface layer or in the charge generation material in the photosensitive layer. To address this problem, a variety of materials have been studies including Patent Literature 3 and 4, hereinafter "PTL 3" and "PTL 4", which disclose addition of a specific compound to a charge generation layer and Patent Literature 5, hereinafter "PTL 5", in which a specific polycarbonate polymer charge transport material is used for a surface layer. However, materials have not been found that can satisfactorily achieve various characteristics including suppressing an effect of temperature and humidity to photoreceptors.

Moreover, although the techniques disclosed in Patent Literature 6 and 7 and 8, hereinafter "PTL 6", "PTL 7" and "PTL 8" could address the problem of degradation of characteristics due to the temperature and humidity conditions, the techniques were not satisfactory with regard to the stain resistance on the surface of photoreceptors.

Further, Patent Literature 9, hereinafter "PTL 9", proposes an outermost surface layer of a photosensitive layer which contains a certain phthalic ester compound and a certain three-dimensional cross-linked polymer. However, PTL 9 does not refer to the stain resistance of the surface of the photoreceptor or the effect of temperature and humidity. Further, Patent Literature 10, hereinafter "PTL 10", discloses a phthalic acid compound useful as a pest repellent and Patent Literature 11, hereinafter "PTL 11", discloses a thermosensitive recording paper having a thermosensitive colour developing layer which contains a certain aromatic compound having four ester groups. However, PTL 10 and PTL 11 do not refer to use of the compounds in photoreceptors.

CITATION LIST—PATENT LITERATURE

PTL 1 is Japanese Patent Application Laid-open No. H11-160958;
PTL 2 is Japanese Patent Application Laid-open No. 2008-164757;
PTL 3 is Japanese Patent Application Laid-open No. H6-118687;
PTL 4 is Japanese Patent Application Laid-open No. H7-168381;
PTL 5 is Japanese Patent Application Laid-open No. 2001-13708;
PTL 6 is Japanese Patent Application Laid-open No. 2007-279446;
PTL 7 is Japanese Patent No. 5429654;
PTL 8 is Japanese Patent No. 5534030;
PTL 9 is Japanese Patent Application Laid-open No. 2013-41101;
PTL 10 is Japanese Patent Application Laid-open No. S60-222445; and
PTL 11 is Japanese Patent Application Laid-open No. S61-27284.

As described above, various techniques for improving photoreceptors have been conventionally proposed. However, the techniques disclosed in the above patent literature do not allow sufficient prevention of adverse effects of temperature and humidity environments to photoreceptors while fulfilling sufficient stain resistance and various characteristics of photoreceptors. Thus, there is a need for further improvements.

Thus, an object of the present invention is to provide an electrophotographic photoreceptor which fulfils sufficient stain resistance and various characteristics of photoreceptors and is less affected by temperature and humidity environments, as well as a method for manufacturing the same and an electrophotographic device.

SUMMARY OF INVENTION

The inventors of the present invention extensively studied in order to solve the above problem and, as a result, found that by adding a compound having a specific structure to an outermost layer of a photoreceptor, penetration of a component exuded from a constituent of a charging roller or transfer roller into the surface of the photoreceptor can be prevented regardless of properties of the charge transport material used, resulting in an improvement in stain resistance. As a result, the inventors of the present invention found that an electrophotographic photoreceptor can be obtained which is not affected by the type of organic materials used or the temperature or humidity of the operating environment, has improved stability of electric characteristics and does not cause image defects such as those due to memory.

At present, polycarbonate or polyarylate resins and the like are mainly used for the outermost layer of photoreceptors. When a photosensitive layer is formed, various functional materials are dissolved in a solvent and the solution is applied on a conductive substrate by dip coating, spray coating or the like to form a coating film. On this occasion, the resin binder forms the film by wrapping around the functional materials; however, at a molecular level, voids are produced in the film which are non-negligible in size. It is expected that when voids are large, electric properties are deteriorated.

Therefore, it is believed that by filling the voids formed by the resin binder with molecules having appropriate size, it is possible to form a film having an increased strength, resulting in provision of a photoreceptor of which electric and image characteristics are not deteriorated due to variation of environment. As a result of the above considerations, the inventors of the present invention achieved the present invention.

Thus, the electrophotographic photoreceptor of the present invention is an electrophotographic photoreceptor comprising a conductive substrate; and a photosensitive layer provided on the conductive substrate, wherein an outermost layer contains a compound having the structure represented by general formula (I) below:

(I)

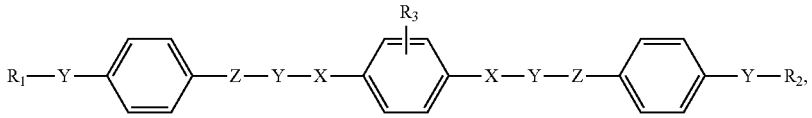

where $R_1$ and $R_2$ each independently represent a $C_{1-12}$ alkyl group or a $C_{5-12}$ cycloalkyl group; $R_3$ represents a hydrogen atom, a halogen atom, a substituted or unsubstituted $C_{1-6}$ alkyl group, a substituted or unsubstituted $C_{1-6}$ alkoxyl group, a $C_{6-20}$ aryl group or a heterocycle group; X and Z each represent a single bond or a $C_{1-6}$ alkylene group which may be substituted; and Y represents a OCO group or COO group.

In the photoreceptor of the present invention, the photosensitive layer is preferably the outermost layer. In this case, the photosensitive layer may be formed of a charge generation layer and a charge transport layer, and the charge transport layer may be the outermost layer; the photosensitive layer may be a positive-charged single layer photoreceptor and further, the photosensitive layer may be formed of a charge transport layer and a charge generation layer, and the charge generation layer may be the outermost layer. In the photoreceptor of the present invention, a surface protection layer may be provided on the photosensitive layer and the surface protection layer may be the outermost layer.

In the photoreceptor of the present invention, the compound having the structure represented by general formula (I) above is suitably a compound having a structure represented by formula (I-1) below. In the photoreceptor of the present invention, the amount of the compound having the structure represented by general formula (I) above is suitably added at 30 parts by mass or less relative to 100 parts by mass of a resin binder in the layer containing the compound.

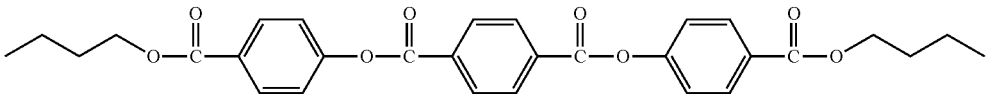

(I-1)

The method for manufacturing an electrophotographic photoreceptor of the present invention is a method for manufacturing an electrophotographic photoreceptor including a step of forming an outermost layer by applying a coating liquid on a conductive substrate, wherein the coating liquid contains the compound having the structure represented by general formula (I) above. Thus, the method for manufacturing an electrophotographic photoreceptor, comprises providing a coating liquid; and applying the coating liquid onto a conductive substrate to form an outermost layer, wherein the coating liquid contains a compound having a structure represented by general formula (I) below:

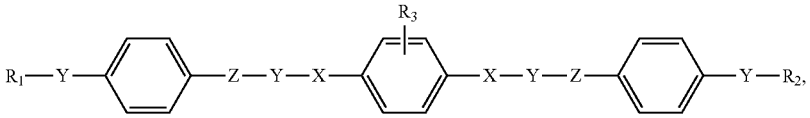

(I)

where $R_1$ and $R_2$ each independently represent a $C_{1-12}$ alkyl group or a $C_{5-12}$ cycloalkyl group; $R_3$ represents a hydrogen atom, a halogen atom, a substituted or unsubstituted $C_{1-6}$ alkyl group, a substituted or unsubstituted $C_{1-6}$ alkoxyl group, a $C_{6-20}$ aryl group or a heterocycle group; X and Z each represent a single bond or a $C_{1-6}$ alkylene group which may be substituted; and Y represents a OCO group or COO group.

Further, the electrophotographic device of the present invention is characterised in that the electrophotographic device includes the electrophotographic photoreceptor of the present invention.

ADVANTAGEOUS EFFECTS OF THE INVENTION

According to the present invention, the above compound is included in a surface layer of a photoreceptor such as a photosensitive layer or a surface protection layer, and thus it is possible to obtain a photoreceptor which has an improved stain resistance regardless of properties of the charge transport material and the like used and has less variation in electric and image characteristics according to variation in environment. In the present invention, by including the compound also in an intermediate layer, it is possible to obtain a photoreceptor which has less variation in electric and image characteristics according to variation in environment. Thus, according to the present invention, it is possible to obtain an electrophotographic photoreceptor which is not affected by the type of organic materials used or variation in the temperature or humidity of operating environment, has improved stability of electric characteristics and does not cause image defects such as those due to memory.

DETAILED DESCRIPTION OF THE EXEMPLARY EMBODIMENTS

Figure 1A:
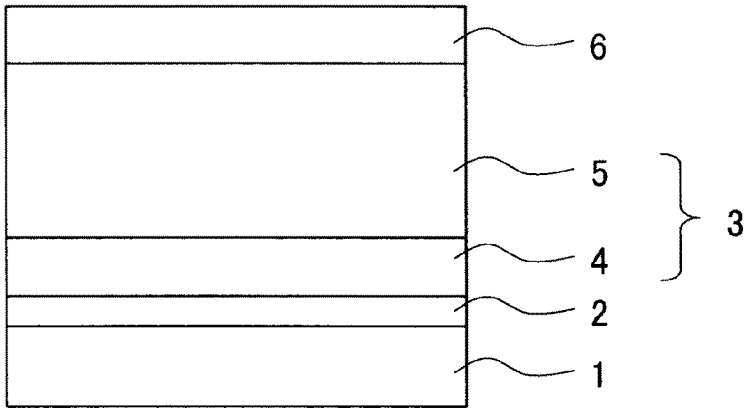
FIG. 1A is a schematic section view showing an example of a negative charge function separation stacked electrophotographic photoreceptor according to the present invention.

Specific embodiments of the electrophotographic photoreceptor according to the present invention are now described in detail with referring to the drawings. The present invention is not limited by the following descriptions.

Figure 1B:
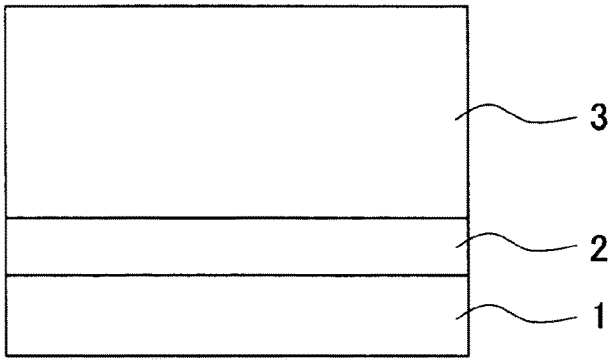
FIG. 1B is a schematic section view showing an example of a positive-charged single layer electrophotographic photoreceptor.
Figure 1C:
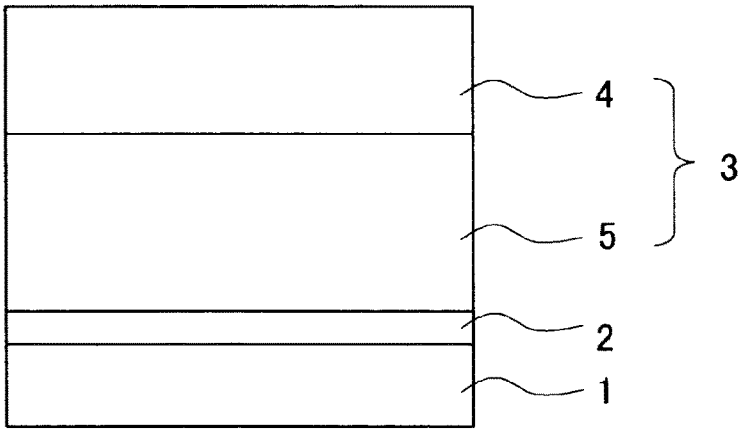
FIG. 1C is a schematic section view showing an example of a positive charge function separation stacked electrophotographic photoreceptor.

As described above, electrophotographic photoreceptors are generally classified into function separation stacked electrophotographic photoreceptors including negative charge stacked photoreceptors and positive charge stacked photoreceptors, and single layer photoreceptors which are mainly of positive charge. FIG. 1A, FIG. 1B and FIG. 1C are schematic section views showing an exemplary electrophotographic photoreceptor of the present invention, in which FIG. 1A shows an example of a negative charge function separation stacked electrophotographic photoreceptor, FIG. 1B shows an example of a positive-charged single layer electrophotographic photoreceptor and FIG. 1C shows an example of a positive charge function separation stacked electrophotographic photoreceptor.

As shown in the figures, in the negative charge stacked photoreceptor, an under-coating layer 2, and a photosensitive layer 3 formed of a charge generation layer 4 having a charge generation function and a charge transport layer 5 having a charge transport function, are stacked in this order on a conductive substrate 1. In the positive-charged single layer photoreceptor, an under-coating layer 2 and a single photosensitive layer 3 having both a charge generation function and a charge transport function are stacked in this order on a conductive substrate 1. In the positive charge stacked photoreceptor, an under-coating layer 2, and a photosensitive layer 3 formed of a charge transport layer 5 having a charge transport function and a charge generation layer 4 having a charge generation function, are stacked in this order on a conductive substrate 1. In any type of photoreceptors, the under-coating layer 2 may be provided as needed and a surface protection layer 6 may be further provided on the photosensitive layer 3. In the present invention, the term "photosensitive layer" is based on a concept encompassing both a single-layer photosensitive layer and a stacked photosensitive layer in which a charge generation layer and a charge transport layer are stacked.

In the present invention, it is important that the compound having the structure represented by general formula (I) above is included in any of the photosensitive layer, the surface protection layer or the like which is an outermost layer of the photoreceptor. Namely, when the photoreceptor has a configuration in which the outermost layer is a photosensitive layer, a desired effect of the present invention can be obtained by including the compound in the photosensitive layer. In this case, when the photoreceptor is a negative charge stacked photoreceptor in which the photosensitive layer is formed of a charge generation layer and a charge transport layer, and the outermost layer is the charge transport layer, a desired effect of the present invention can be obtained by including the compound in the charge transport layer. When the photoreceptor is a positive-charged single layer photoreceptor in which the photosensitive layer is of positive-charged single layer, a desired effect of the present invention can be obtained by including the compound in the single-layer photosensitive layer. When the photoreceptor is a positive charge stacked photoreceptor in which the photosensitive layer is formed of a charge transport layer and a charge generation layer, and the outermost layer is the charge generation layer, a desired effect of the present invention can be obtained by including the compound in the charge generation layer. Meanwhile, when the photoreceptor has a configuration in which a surface protection layer is provided on a photosensitive layer and the surface protection layer is the outermost layer, a desired effect of the present invention can be obtained by including the compound in the surface protection layer.

In any of the above photoreceptors, the amount of the compound added to the outermost layer is preferably 30 parts by mass or less, more preferably 1 to 30 parts by mass and particularly preferably 3 to 25 parts by mass relative to 100 parts by mass of a resin binder in the layer containing the compound. It is not preferable for the amount of the compound to be more than 30 parts by mass, because the compound tends to be deposited. The amount of the compound added to a layer other than the photosensitive layer is the same as above.

Specific examples of the compound having the structure represented by the general formula (I) according to the present invention are shown herein below. However, the compound used in the present invention is not limited thereto.

(I-1)

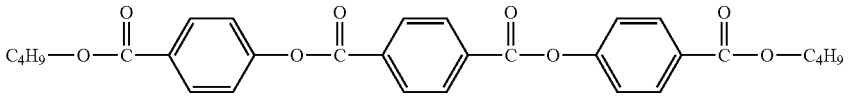

(I-2)

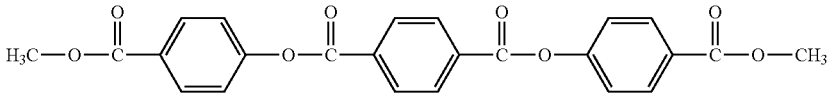

(I-3)

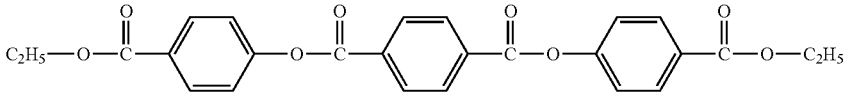

(I-4)

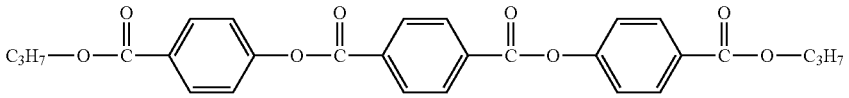

(I-5)

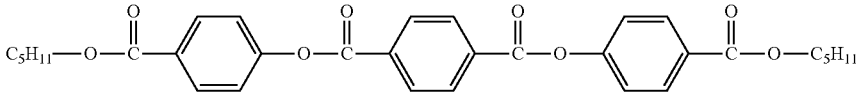

(I-6)

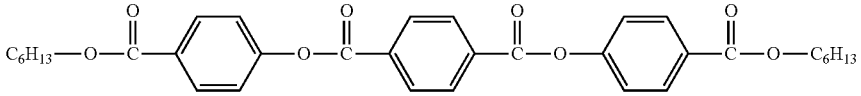

(I-7)

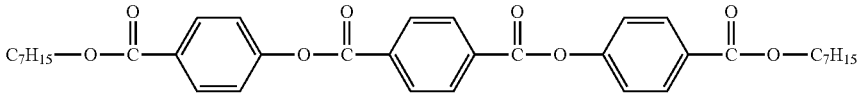

-continued (I-8)

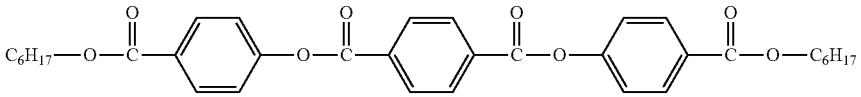

(I-9)

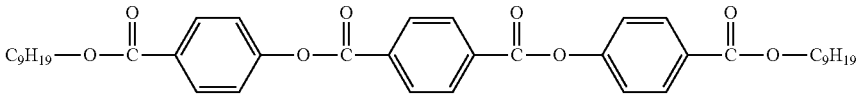

(I-10)

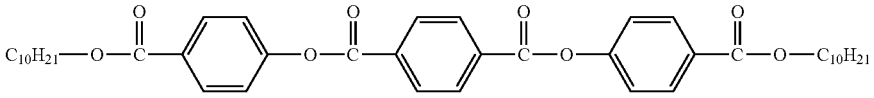

(I-11)

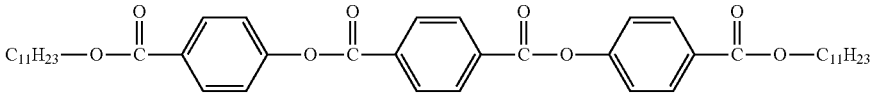

(I-12)

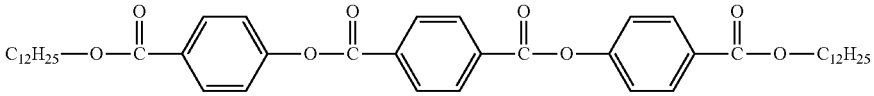

(I-13)

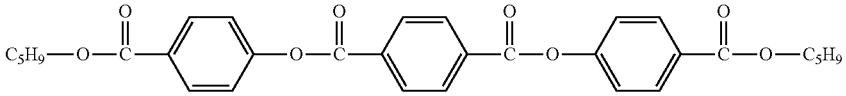

(I-14)

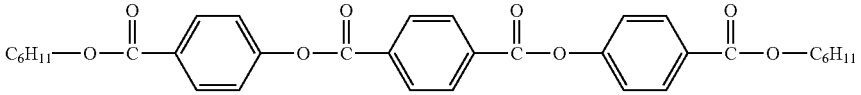

(I-15)

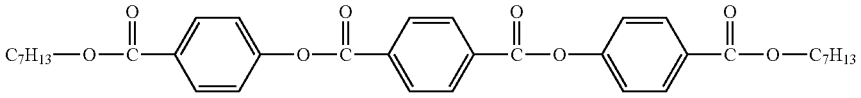

(I-16)

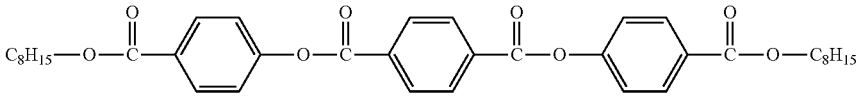

TABLE 1

| Compound | Groups in general formula (I) | | | | | |
|---|---|---|---|---|---|---|
| | X | Y | Z | $R_1$ | $R_2$ | $R_3$ |
| No. I-17 | Single bond | —C(=O)—O— | $CH_2$ | $CH_3$ | $CH_3$ | 2-Me |
| No. I-18 | Single bond | —C(=O)—O— | $CH_2$ | $C_2H_5$ | $C_2H_5$ | 2-Me |
| No. I-19 | Single bond | —C(=O)—O— | $CH_2$ | $C_3H_7$ | $C_3H_7$ | 2-Me |
| No. I-20 | Single bond | —C(=O)—O— | $CH_2$ | $C_4H_9$ | $C_4H_9$ | 2-Me |
| No. I-21 | Single bond | —C(=O)—O— | $CH_2$ | $C_5H_{11}$ | $C_5H_{11}$ | 2-Me |

TABLE 1-continued

| Compound | Groups in general formula (I) | | | | | |
|---|---|---|---|---|---|---|
| | X | Y | Z | $R_1$ | $R_2$ | $R_3$ |
| No. I-22 | Single bond | —C(=O)—O— | $CH_2$ | $C_6H_{13}$ | $C_6H_{13}$ | 2-Me |
| No. I-23 | Single bond | —C(=O)—O— | $CH_2$ | $C_5H_9$ | $C_5H_9$ | 2-Me |
| No. I-24 | Single bond | —C(=O)—O— | $CH_2$ | $C_6H_{11}$ | $C_6H_{11}$ | 2-Me |
| No. I-25 | $CH_2$ | —C(=O)—O— | $CH_2$ | $CH_3$ | $CH_3$ | 2-Me |
| No. I-26 | $CH_2$ | —C(=O)—O— | $CH_2$ | $C_2H_5$ | $C_2H_5$ | 2-Me |

TABLE 1-continued

| Compound | Groups in general formula (I) | | | | | |
|---|---|---|---|---|---|---|
| | X | Y | Z | $R_1$ | $R_2$ | $R_3$ |
| No. I-27 | $CH_2$ | —C(=O)—O— | $CH_2$ | $C_3H_7$ | $C_3H_7$ | 2-Me |
| No. I-28 | $CH_2$ | —C(=O)—O— | $CH_2$ | $C_4H_9$ | $C_4H_9$ | 2-Me |
| No. I-29 | $CH_2$ | —C(=O)—O— | $CH_2$ | $C_5H_{11}$ | $C_5H_{11}$ | 2-Me |
| No. I-30 | $CH_2$ | —C(=O)—O— | $CH_2$ | $C_6H_{13}$ | $C_6H_{13}$ | 2-Me |
| No. I-31 | $CH_2$ | —C(=O)—O— | $CH_2$ | $C_5H_9$ | $C_5H_9$ | 2-Me |
| No. I-32 | $CH_2$ | —C(=O)—O— | $CH_2$ | $C_6H_{11}$ | $C_6H_{11}$ | 2-Me |
| No. I-33 | Single bond | —C(=O)—O— | Single bond | $CH_3$ | $CH_3$ | 2-Me |
| No. I-34 | Single bond | —C(=O)—O— | Singl bond | $C_2H_5$ | $C_2H_5$ | 2-Me |
| No. I-35 | Single bond | —C(=O)—O— | Single bond | $C_3H_7$ | $C_3H_7$ | 2-Me |
| No. I-36 | Single bond | —C(=O)—O— | Single bond | $C_4H_9$ | $C_4H_9$ | 2-Me |

TABLE 2

| Compound | Groups in general formula (I) | | | | | |
|---|---|---|---|---|---|---|
| | X | Y | Z | $R_1$ | $R_2$ | $R_3$ |
| No. I-37 | Single bond | —C(=O)—O— | Single bond | $C_5H_{11}$ | $C_5H_{11}$ | 2-Me |
| No. I-38 | Single bond | —C(=O)—O— | Single bond | $C_6H_{13}$ | $C_6H_{13}$ | 2-Me |
| No. I-39 | Single bond | —C(=O)—O— | Single bond | $C_5H_9$ | $C_5H_9$ | 2-Me |
| No. I-40 | Single bond | —C(=O)—O— | Single bond | $C_6H_{11}$ | $C_6H_{11}$ | 2-Me |
| No. I-41 | Single bond | —O—C(=O)— | Single bond | $CH_3$ | $CH_3$ | 2-Me |
| No. I-42 | Single bond | —O—C(=O)— | Single bond | $C_2H_5$ | $C_2H_5$ | 2-Me |
| No. I-43 | Single bond | —O—C(=O)— | Single bond | $C_3H_7$ | $C_3H_7$ | 2-Me |

TABLE 2-continued

| Compound | Groups in general formula (I) | | | | | |
|---|---|---|---|---|---|---|
| | X | Y | Z | $R_1$ | $R_2$ | $R_3$ |
| No. I-44 | Single bond | —O—C(=O)— | Single bond | $C_4H_9$ | $C_4H_9$ | 2-Me |
| No. I-45 | Single bond | —O—C(=O)— | Single bond | $C_5H_{11}$ | $C_5H_{11}$ | 2-Me |
| No. I-46 | Single bond | —O—C(=O)— | Single bond | $C_6H_{13}$ | $C_6H_{13}$ | 2-Me |
| No. I-47 | Single bond | —O—C(=O)— | Single bond | $C_5H_9$ | $C_5H_9$ | 2-Me |
| No. I-48 | Single bond | —O—C(=O)— | Single bond | $C_6H_{11}$ | $C_6H_{11}$ | 2-Me |
| No. I-49 | $CH_2$ | —O—C(=O)— | Single bond | $CH_3$ | $CH_3$ | 2-Me |
| No. I-50 | $CH_2$ | —O—C(=O)— | Single bond | $C_2H_5$ | $C_2H_5$ | 2-Me |
| No. I-51 | $CH_2$ | —O—C(=O)— | Single bond | $C_3H_7$ | $C_3H_7$ | 2-Me |
| No. I-52 | $CH_2$ | —O—C(=O)— | Single bond | $C_4H_9$ | $C_4H_9$ | 2-Me |
| No. I-53 | $CH_2$ | —O—C(=O)— | Single bond | $C_5H_{11}$ | $C_5H_{11}$ | 2-Me |
| No. I-54 | $CH_2$ | —O—C(=O)— | Single bond | $C_6H_{13}$ | $C_6H_{13}$ | 2-Me |
| No. I-55 | $CH_2$ | —O—C(=O)— | Single bond | $C_5H_9$ | $C_5H_9$ | 2-Me |
| No. I-56 | $CH_2$ | —O—C(=O)— | Single bond | $C_6H_{11}$ | $C_6H_{11}$ | 2-Me |

TABLE 3

| Compound | Groups in general formula (I) | | | | | |
|---|---|---|---|---|---|---|
| | X | Y | Z | $R_1$ | $R_2$ | $R_3$ |
| No. I-57 | Single bond | —O—C(=O)— | $CH_2$ | $CH_3$ | $CH_3$ | 2-Me |
| No. I-58 | Single bond | —O—C(=O)— | $CH_2$ | $C_2H_5$ | $C_2H_5$ | 2-Me |
| No. I-59 | Single bond | —O—C(=O)— | $CH_2$ | $C_3H_7$ | $C_3H_7$ | 2-Me |

TABLE 3-continued

| Compound | Groups in general formula (I) | | | | | |
|---|---|---|---|---|---|---|
| | X | Y | Z | $R_1$ | $R_2$ | $R_3$ |
| No. I-60 | Single bond | —O—C(=O)— | $CH_2$ | $C_4H_9$ | $C_4H_9$ | 2-Me |
| No. I-61 | Single bond | —O—C(=O)— | $CH_2$ | $C_5H_{11}$ | $C_5H_{11}$ | 2-Me |
| No. I-62 | Single bond | —O—C(=O)— | $CH_2$ | $C_6H_{13}$ | $C_6H_{13}$ | 2-Me |
| No. I-63 | Single bond | —O—C(=O)— | $CH_2$ | $C_5H_9$ | $C_5H_9$ | 2-Me |
| No. I-64 | Single bond | —O—C(=O)— | $CH_2$ | $C_6H_{11}$ | $C_6H_{11}$ | 2-Me |
| No. I-65 | $CH_2$ | —O—C(=O)— | $CH_2$ | $CH_3$ | $CH_3$ | 2-Me |
| No. I-66 | $CH_2$ | —O—C(=O)— | $CH_2$ | $C_2H_5$ | $C_2H_5$ | 2-Me |
| No. I-67 | $CH_2$ | —O—C(=O)— | $CH_2$ | $C_3H_7$ | $C_3H_7$ | 2-Me |
| No. I-68 | $CH_2$ | —O—C(=O)— | $CH_2$ | $C_4H_9$ | $C_4H_9$ | 2-Me |
| No. I-69 | $CH_2$ | —O—C(=O)— | $CH_2$ | $C_5H_{11}$ | $C_5H_{11}$ | 2-Me |
| No. I-70 | $CH_2$ | —O—C(=O)— | $CH_2$ | $C_6H_{13}$ | $C_6H_{13}$ | 2-Me |
| No. I-71 | $CH_2$ | —O—C(=O)— | $CH_2$ | $C_5H_9$ | $C_5H_9$ | 2-Me |
| No. I-72 | $CH_2$ | —O—C(=O)— | $CH_2$ | $C_6H_{11}$ | $C_6H_{11}$ | 2-Me |

The conductive substrate 1 serves as an electrode of the photoreceptor as well as a support of the layers included in the photoreceptor. The conductive substrate 1 may have any shape such as a cylinder, a plate and a film and may be made of metals such as aluminium, stainless steel and nickel or may be a glass or resin which is subjected to conductive treatment on the surface thereof.

The under-coating layer 2 includes a layer containing a resin as a main component or a metal oxide film such as alumite and is provided as needed for the purpose of, for example, controlling charge injection from the conductive substrate to the photosensitive layer, coating the defects on the surface of the substrate or improving the adhesion between the photosensitive layer and an under layer. Examples of the resin material used for the under-coating layer include insulating polymers such as casein, polyvinyl alcohol, polyamide, melamine and cellulose and conductive polymers such as polythiophene, polypyrrole and polyaniline, which resins may be used respectively alone or as a mixture of appropriate combinations. A metal oxide such as titanium dioxide and zinc oxide may be added to the resin.

Negative Charge Stacked Photoreceptor

In the negative charge stacked photoreceptor, the charge generation layer 4 is formed by, for example, a method in which a coating liquid containing charge generation material particles dispersed in a resin binder is applied. The charge generation layer 4 receives light and generates charge. It is important for the charge generation layer 4 to have a high charge generation rate and an ability to inject the generated charge into the charge transport layer 5. The charge generation layer 4 is desirable to have low electric field dependence and have a high injection ability even in a low electric field.

As the charge generation material, phthalocyanine compounds such as X-form metal free phthalocyanine, τ-form metal free phthalocyanine, α-form titanyl phthalocyanine, β-form titanyl phthalocyanine, Y-form titanyl phthalocyanine, γ-form titanyl phthalocyanine, amorphous titanyl phthalocyanine and ε-form copper phthalocyanine, various azo pigments, anthanthrone pigments, thiapyrillium pigments, perylene pigments, perynone pigments, squarylium pigments, quinacridone pigments and the like may be respectively used alone or in appropriate combinations. Suitable substances may be selected according to the light wavelength range of the exposure light source used for image formation.

As the resin binder for the charge generation layer 4, polymers and copolymers of polycarbonate resins, polyester resins, polyamide resins, polyurethane resins, vinyl chloride resins, vinyl acetate resins, phenoxy resins, polyvinyl acetal resins, polyvinyl butyral resins, polystyrene resins, polysulphone resins, diallyl phthalate resins, methacrylic ester resins and the like may be used in appropriate combinations.

As the charge generation layer 4 is required to have a charge generation function, the thickness thereof depends on light absorption coefficient of the charge generation material and is generally 1 μm or less and suitably 0.5 μm or less. The charge generation layer may contain a charge generation material as a main component and a charge transport material may be added thereto.

The amount of the charge generation material added to the charge generation layer 4 is, relative to 100 parts by mass of the resin binder, suitably 30 to 90 parts by mass and more suitably 40 to 80 parts by mass. The content of the resin binder is, relative to the solid content of the charge generation layer 4, suitably 10 to 90% by mass and more suitably 20 to 80% by mass.

The charge transport layer 5 is mainly formed with a charge transport material and a resin binder. As the resin binder for the charge transport layer 5, polymers and copolymers of various polycarbonate resins such as bisphenol A-based, bisphenol Z-based, bisphenol A-biphenyl copolymer-based and bisphenol Z-biphenyl copolymer-based polycarbonate resins, polyarylate resins, polyphenylene resins, polyester resins, polyvinyl acetal resins, polyvinyl butyral resins, polyvinyl alcohol resins, vinyl chloride resins, vinyl acetate resins, polyethylene resins, polypropylene resins, acryl resins, polyurethane resins, epoxy resins, melamine resins, silicone resins, polyamide resins, polystyrene resins, polyacetal resins, polysulphone resins, methacrylic esters and the like may be used respectively alone or as a mixture in appropriate combinations. The same type of resins having different molecular weights may be mixed and used.

As the charge transport material for the charge transport layer 5, various hydrazone compounds, styryl compounds, diamine compounds, butadiene compounds, indole compounds and the like may be used respectively alone or as a mixture in appropriate combinations. Examples of the charge transport material include the compounds shown in (II-1) to (II-16) below without limitation.
II-1
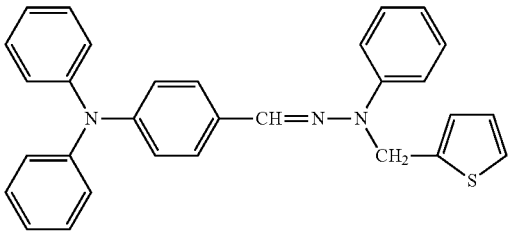
II-2
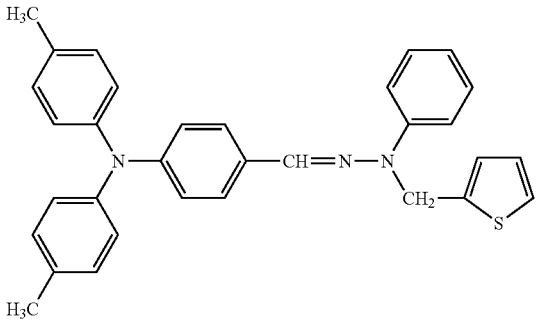
II-3
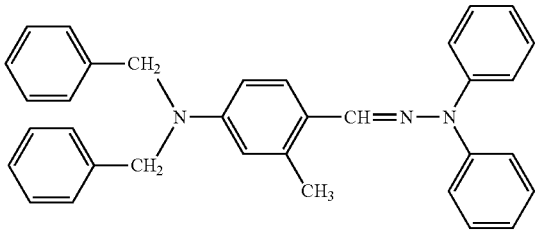
II-4
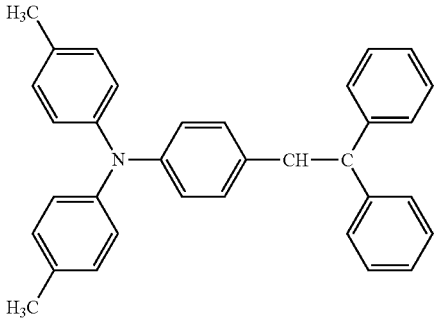
II-5
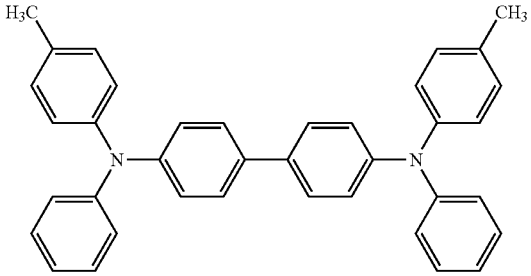
II-6
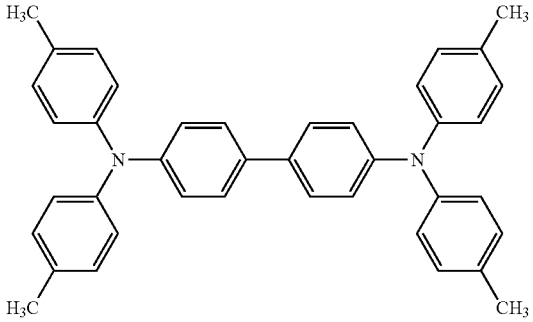
II-7
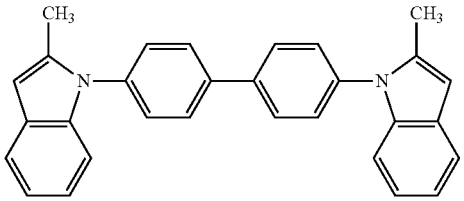
II-8
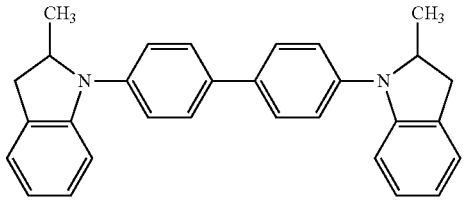
II-9
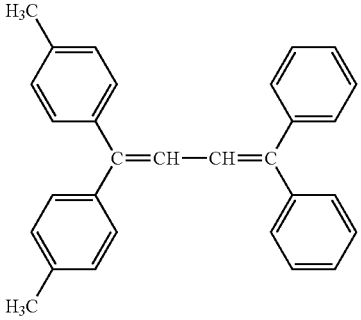
II-10
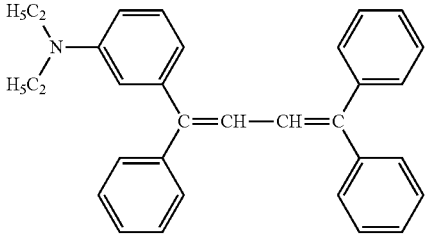

-continued
II-11
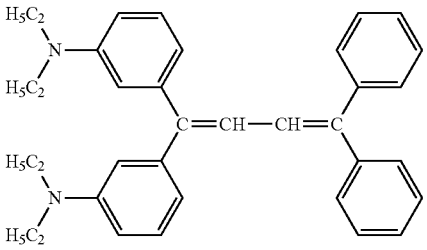
II-12
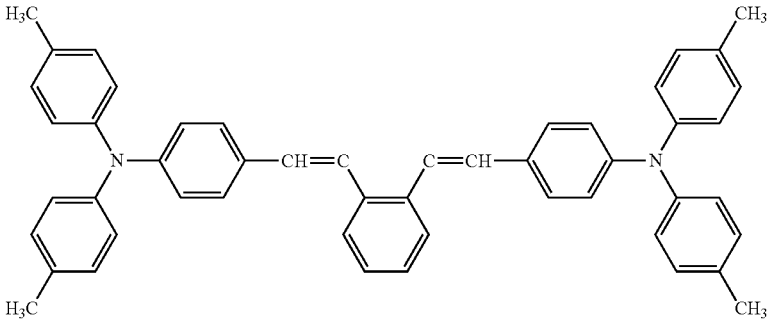
II-13
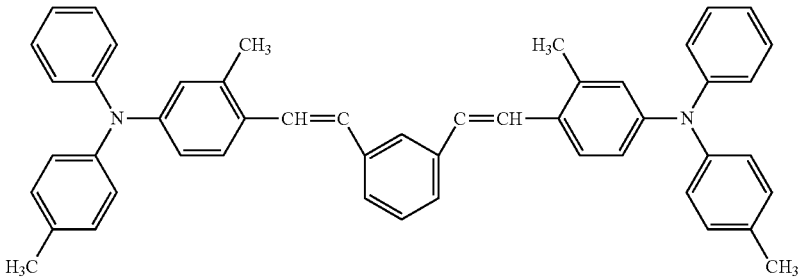
II-14
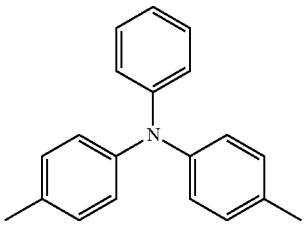
II-15
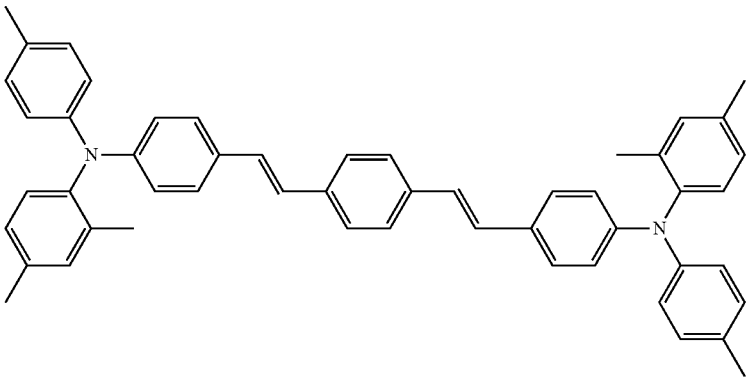

-continued

II-16

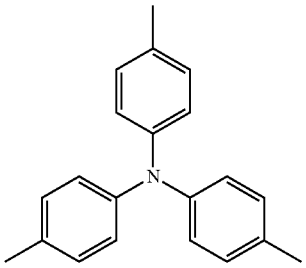

The amount of the charge transport material used in the charge transport layer 5 is, relative to 100 parts by mass of the resin binder, suitably 50 to 90 parts by mass and more suitably 60 to 80 parts by mass. The content of the resin binder is, relative to the solid content of the charge transport layer 5, suitably 10 to 90% by mass and more suitably 20 to 80% by mass.

The thickness of the charge transport layer 5 is, in order to maintain a practically effective surface potential, preferably in the range of 3 to 50 μm and more preferably in the range of 15 to 40 μm.

Single Layer Photoreceptor

In the present invention, a single-layer photosensitive layer 3 is mainly formed of a charge generation material, a hole transport material, an electron transport material (acceptor compound) and a resin binder.

Examples of the charge generation material for a single layer photoreceptor used include phthalocyanine pigments, azo pigments, anthanthrone pigments, perylene pigments, perynone pigments, polycyclic quinone pigments, squarylium pigments, thiapyrillium pigments, quinacridone pigments and the like. The above charge generation materials may be used alone or in combination of two or more. Particularly, in the electrophotographic photoreceptor of the present invention, disazo pigments and trisazo pigments are preferable azo pigments, N,N'-bis(3,5-dimethylphenyl)-3,4:9,10-perylene-bis(carboxyimide) is a preferable perylene pigment, and metal free phthalocyanine, copper phthalocyanine and titanyl phthalocyanine are preferable phthalocyanine pigments. Further, when X-form metal free phthalocyanine, τ-form metal free phthalocyanine, ε-form copper phthalocyanine, α-form titanyl phthalocyanine, β-form titanyl phthalocyanine, γ-form titanyl phthalocyanine, amorphous titanyl phthalocyanine and titanyl phthalocyanines disclosed in Japanese Patent Application Laid-open No. H8-209023, U.S. Pat. No. 5,736,282 and U.S. Pat. No. 5,874,570 and having a maximum peak at the Bragg's angle 2θ of 9.6° in a CuKα: X-ray diffraction spectrum are used, the sensitivity, durability and image quality are significantly improved. The content of the charge generation material is, relative to the solid content of the single-layer photosensitive layer 3, suitably 0.1 to 20% by mass and more suitably 0.5 to 10% by mass.

Examples of the hole transport material which can be used include hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazole, polysilane and the like. The above hole transport materials may be used alone or in combination of two or more. The hole transport material used for the present invention is preferably the one which has excellent hole transport ability generated at irradiation of light and is suitable in combination with the charge generation material. The content of the hole transport material is, relative to the solid content of the single-layerphotosensitive layer 3, suitably 3 to 80% by mass and more suitably 5 to 60% by mass.

Examples of the electron transport material (acceptor compound) include succinic anhydride, maleic anhydride, dibromosuccinic anhydride, phthalic anhydride, 3-nitrophthalic anhydride, 4-nitrophthalic anhydride, pyromellitic dianhydride, pyromellitic acid, trimellitic acid, trimellitic anhydride, phthalimide, 4-nitrophthalimide, tetracyanoethylene, tetracyanoxydimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, azoquinone compounds and the like. The above electron transport materials may be used alone or in combination of two or more. The content of the electron transport material is, relative to the solid content of the single-layer photosensitive layer 3, suitably 1 to 50% by mass and more suitably 5 to 40% by mass.

The resin binder for the single-layer photosensitive layer 3 which can be used is polymers and copolymers of various polycarbonate resins such as bisphenol A-based, bisphenol Z-based, bisphenol A-biphenyl copolymer-based and bisphenol Z-biphenyl copolymer-based polycarbonate resins, polyphenylene resins, polyester resins, polyvinyl acetal resins, polyvinyl butyral resins, polyvinyl alcohol resins, vinyl chloride resins, vinyl acetate resins, polyethylene resins, polypropylene resins, acryl resins, polyurethane resins, epoxy resins, melamine resins, silicone resins, polyamide resins, polystyrene resins, polyacetal resins, polyarylate resins, polysulphone resins, methacrylic ester resins and the like. The same type of resins having different molecular weights may be mixed and used.

The content of the resin binder is, relative to the solid content of the single-layer photosensitive layer 3, suitably 10 to 90% by mass and more suitably 20 to 80% by mass.

The thickness of the single-layer photosensitive layer 3 is, in order to maintain a practically effective surface potential, preferably in the range of 3 to 100 μm and more preferably in the range of 5 to 40 μm.

Positive Charge Stacked Photoreceptor

In the positive charge stacked photoreceptor, a charge transport layer 5 mainly contains a charge transport material and a resin binder. The charge transport material and the resin binder may be formed with the same materials mentioned for the charge transport layer 5 in the negative charge stacked photoreceptor without particular limitation. The contents of the materials and the thickness of the charge transport layer 5 may also be the same as those in the negative charge stacked photoreceptor.

The charge generation layer 4 provided on the charge transport layer 5 is mainly formed of a charge generation material, a hole transport material, an electron transport material (acceptor compound) and a resin binder. The charge generation material, the hole transport material, the electron transport material and the resin binder may be formed with the same materials mentioned for the single-layer photosensitive layer 3 in the single layer photoreceptor without particular limitation. The contents of the materials and the thickness of the charge generation layer 4 may also be the same as those in the single-layer photosensitive layer 3 in the single layer photoreceptor.

In the present invention, the under-coating layer 2, the photosensitive layer 3, the charge generation layer 4 and the charge transport layer 5 may contain, as needed, various additives for the purpose of, for example, improving sensitivity, reducing the residual potential, improving environmental resistance or stability against harmful light and improving durability including anti-friction. Examples of additives which can be used include, in addition to the compound having the structure represented by general formula (I) above, succinic anhydride, maleic anhydride, dibromosuccinic anhydride, pyromellitic dianhydride, pyromellitic acid, trimellitic acid, trimellitic anhydride, phthalimide, 4-nitrophthalimide, tetracyanoethylene, tetracyanoxydimethane, chloranil, bromanil, o-nitrobenzoic acid, trinitrofluorenone and the like compounds. In addition, a degradation preventing agent such as an antioxidant and a light stabiliser may also be added. The compound which is used for the purpose may include, but is not limited to, chromanol derivatives such as tocopherol, and ether compounds, ester compounds, polyarylalkane compounds, hydroquinone derivatives, diether compounds, benzophenone derivatives, benzotriazole derivatives, thioether compounds, phenylenediamine derivatives, phosphonic esters, phosphite esters, phenol compounds, hindered phenol compounds, linear amine compounds, cyclic amine compounds, hindered amine compounds and the like.

The under-coating layer 2, the photosensitive layer 3, the charge generation layer 4 and the charge transport layer 5 may also contain a levelling agent such as silicone oil and fluorine oil, for the purpose of improving the levelling property of the formed films and imparting further lubricity. For the purpose of, for example, adjusting the film hardness, reducing the friction coefficient and imparting lubricity, the layers may also contain microparticles of metal oxides such as silicon oxide (silica), titanium oxide, zinc oxide, calcium oxide, aluminium oxide (alumina) and zirconium oxide, metal sulphides such as barium sulphate and calcium sulphate or metal nitrides such as silicon nitride and aluminium nitride or particles of fluororesins such as tetrafluoroethylene resins or particles of fluorine comb-shaped graft polymerisation resins and the like. The layers may also contain, as needed, other well-known additives in the range that does not significantly impair electrophotographic properties.

Further, in the present invention, a surface protection layer 6 may be provided as needed on the surface of the photosensitive layer for the purpose of further improving environmental resistance and mechanical strength. It is desirable that the surface protection layer 6 is formed with a material having excellent durability against mechanical stress and environmental resistance and has an ability to transmit the light to which the charge generation layer reacts with a loss as low as possible.

The surface protection layer 6 is formed of a layer mainly containing a resin binder, or an inorganic thin film of amorphous carbon and the like. For the purpose of, for example, improving conductivity, reducing the friction coefficient and imparting lubricity, microparticles of metal oxides such as silicon oxide (silica), titanium oxide, zinc oxide, calcium oxide, aluminium oxide (alumina) and zirconium oxide, metal sulphides such as barium sulphate and calcium sulphate or metal nitrides such as silicon nitride and aluminium nitride or particles of fluororesins such as tetrafluoroethylene resins or particles of fluorine comb-shaped graft polymerisation resins and the like may be added to the resin binder.

The surface protection layer 6 may contain the compound having the structure represented by general formula (I) above according to the present invention. The surface protection layer 6 may also contain a charge transport material or an electron accepting material used for the photosensitive layer for the purpose of imparting a charge transport ability, or contain a levelling agent such as silicone oil and fluorine oil for the purpose of improving the levelling property of the formed films and imparting lubricity.

The thickness of the surface protection layer 6 may be dependent on the composition of the surface protection layer; however, the thickness may be arbitrarily selected in the range which does not cause adverse effects such as an increase in the residual potential after repetitive use.

Method for Manufacturing a Photoreceptor

When the photoreceptor of the present invention is manufactured, it is important that a coating liquid which is applied onto a conductive substrate to form the outermost layer contains the compound having the structure represented by general formula (I) above. As a result, it is possible to obtain a photoreceptor which has an improved stain resistance regardless of the properties of the charge transport material and the like used and has less variation in the electric and image characteristics according to variation in environment. The coating liquid for outermost layer formation is a coating liquid for charge transport layer formation when the outermost layer is a photosensitive layer, particularly a charge transport layer; is a coating liquid for charge generation layer formation when the outermost layer is a charge generation layer; is a coating liquid for single-layer photosensitive layer formation when the outermost layer is a single-layer photosensitive layer; and is a coating liquid for surface protection layer formation when the outermost layer is a surface protection layer. The coating liquid may be used for various coating methods such as dip coating and spray coating without limitation.

Electrophotographic Device

The electrophotographic device of the present invention contains the photoreceptor of the present invention and provides a desired effect by applying the same to various machine processes. Specifically, sufficient effects can be obtained in charging processes including contact charging processes using a charging member such as a roller and a brush and noncontact charging processes using a corotron, scorotron or the like and developing processes including contact developing and noncontact developing using a developing system (developer) of non-magnetic one-component, magnetic one-component, two-component and the like. Particularly, the present invention can exhibit satisfactory stain resistance when a rubber roller formed with a rubber such as a silicone rubber, a urethane rubber, a chloroprene rubber, an epichlorohydrin rubber, an acrylonitrile-butadiene rubber (NBR) and an ethylene-propylene-diene rubber (EPDM) is used as a charging roller and a transfer roller, which is a preferable embodiment.

Figure 2:
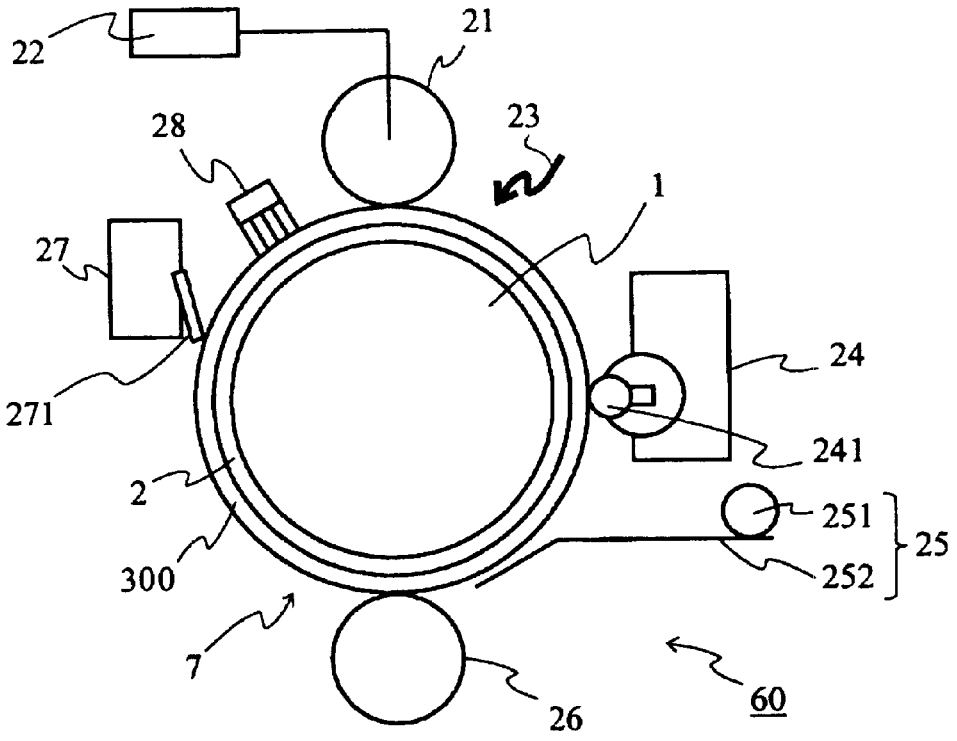
FIG. 2 is a schematic configuration view showing a configuration example of an electrophotographic device of the present invention.

For example, FIG. 2 shows a schematic configuration view of an electrophotographic device of the present invention. An electrophotographic device 60 illustrated is provided with an electrophotographic photoreceptor 7 of the present invention containing the conductive substrate 1 and the under-coating layer 2 and a photosensitive layer 300 which cover the outer circumference of the conductive substrate 1. Particularly, the electrophotographic device of the present invention includes at least an electrophotographic photoreceptor of the present invention having at least a photosensitive layer on a conductive substrate, wherein an outermost layer contains the above compound, and a charging roller. Further, the electrophotographic device 60 illustrated may include a roller charging member 21 disposed at an outer periphery of a photoreceptor 7; a high-voltage power supply 22 which supplies applied voltage to the roller charging member 21; an image exposure member 23; a developing device 24 including a developing roller 241; a paper feeding member 25 including a paper feeding roller 251 and a paper feeding guide 252; a transfer charging device (direct charging) 26; a cleaning device 27 including a cleaning blade 271; and a Neutralizing member 28 and may be a colour printer.

EXAMPLES

Production Examples of Negative Charge Stacked Photoreceptors

Example 1

Onto an outer circumference of an aluminium cylinder having an outer diameter of p 30 mm serving as a conductive substrate was applied by dip coating a coating liquid, as an under-coating layer, prepared by dissolving/dispersing 5 parts by mass of an alcohol soluble nylon (product name: "AmilanCM8000", produced by Toray Industries, Inc.) and 5 parts by mass of titanium oxide microparticles subjected to amino silane treatment in 90 parts by mass of methanol, followed by drying at a temperature of 100° C. for 30 minutes to form an under-coating layer having a film thickness of about 2 μm.

Onto the under-coating layer was applied by dip coating a coating liquid prepared by dispersing, for 1 hour, 1.5 parts by mass of γ-form titanyl phthalocyanine disclosed in Japanese Patent Application Laid-open No. S64-17066 or U.S. Pat. No. 4,898,799 as a charge generation material, and 1.5 parts by mass of polyvinyl butyral (product name "S-LEC B BX-1", produced by Sekisui Chemical Co., Ltd.) as a resin binder in 60 parts by mass of a mixture of equal amounts of dichloromethane and dichloroethane on a sand mill disperser, followed by drying at a temperature of 80° C. for 30 minutes to form a charge generation layer having a film thickness of about 0.3 μm.

Onto the charge generation layer was applied a coating liquid prepared by dissolving 100 parts by mass of the compound represented by structural formula (II-1) above as a charge transport material, and 100 parts by mass of a polycarbonate resin (product name "PanliteTS-2050", produced by Teijin Chemicals Ltd.) as a resin binder in 900 parts by mass of dichloromethane, adding 0.1 parts by mass of silicone oil (KP-340, produced by Shin-Etsu Polymer Co., Ltd.) and further adding 10 parts by mass of the compound represented by formula (I-1) followed by drying at a temperature of 90° C. for 60 minutes to form a charge transport layer having a film thickness of about 25 μm, thereby preparing an electrophotographic photoreceptor. The prepared photoreceptor was brought into contact with a charging roller (rubber roller) and a transfer roller (rubber roller) mounted on a printer LJ4250 produced by HP Inc. and left to stand in an environment with temperature of 60° C. and humidity of 90% for 30 days.

Examples 2 to 72

Electrophotographic photoreceptors were prepared in the same manner as in Example 1 except that the compounds represented by formulae (I-2) to (I-72) were respectively used instead of the compound represented by formula (I-1). The prepared photoreceptors were left to stand for 30 days in the same manner as in Example 1.

Example 73

An electrophotographic photoreceptor was prepared in the same manner as in Example 1 except that 1.0 part by mass of the compound represented by formula (I-1) was added. The prepared photoreceptor was left to stand for 30 days in the same manner as in Example 1.

Example 74

An electrophotographic photoreceptor was prepared in the same manner as in Example 1 except that 3.0 parts by mass of the compound represented by formula (I-1) was added. The prepared photoreceptor was left to stand for 30 days in the same manner as in Example 1.

Example 75

An electrophotographic photoreceptor was prepared in the same manner as in Example 1 except that 6.0 parts by mass of the compound represented by formula (I-1) was added. The prepared photoreceptor was left to stand for 30 days in the same manner as in Example 1.

Example 76

A charge transport layer having a film thickness of 20 μm was formed in the same manner as in Example 1 except that the compound represented by formula (I-1) and the silicone oil were omitted from the coating liquid for the charge transport layer used in Example 1. Onto the charge transport layer was further applied a coating liquid prepared by dissolving 80 parts by mass of the compound represented by structural formula (II-1) above as a charge transport material, and 120 parts by mass of a polycarbonate resin (PCZ-500, produced by Mitsubishi Gas Chemical Company, Inc.) as a resin binder in 900 parts by mass of dichloromethane, adding 0.1 parts by mass of silicone oil (KP-340, produced by Shin-Etsu Polymer Co., Ltd.) and further adding 12 parts by mass of the compound represented by formula (I-1) above, followed by drying at a temperature of 90° C. for 60 minutes to form a surface protection layer having a film thickness of about 10 μm, thereby preparing an electrophotographic photoreceptor. The prepared photoreceptor was left to stand for 30 days in the same manner as in Example 1.

Example 77

An electrophotographic photoreceptor was prepared in the same manner as in Example 1 except that 3.0 parts by mass of the compound represented by formula (I-1) above was added to the under-coating layer and 3.0 parts by mass of the compound represented by formula (I-1) above was added to the charge transport layer. The prepared photoreceptor was left to stand for 30 days in the same manner as in Example 1.

Example 78

An electrophotographic photoreceptor was prepared in the same manner as in Example 1 except that 3.0 parts by mass of the compound represented by formula (I-1) above was added to the charge generation layer and 3.0 parts by mass of the compound represented by formula (I-1) above was added to the charge transport layer. The prepared photoreceptor was left to stand for 30 days in the same manner as in Example 1.

Example 79

An electrophotographic photoreceptor was prepared in the same manner as in Example 1 except that 3.0 parts by mass of the compound represented by formula (I-1) above was added to the under-coating layer, 1.0 part by mass was added to the charge generation layer and 3.0 parts by mass of the compound represented by formula (I-1) above was added to the charge transport layer. The prepared photoreceptor was left to stand for 30 days in the same manner as in Example 1.

Example 80

An electrophotographic photoreceptor was prepared in the same manner as in Example 1 except that α-form titanyl phthalocyanine disclosed in Japanese Patent Application Laid-open No. S61-217050 and U.S. Pat. No. 4,728,592 was used instead of the charge generation material used in Example 1. The prepared photoreceptor was left to stand for 30 days in the same manner as in Example 1.

Example 81

An electrophotographic photoreceptor was prepared in the same manner as in Example 1 except that X-form metal free phthalocyanine (produced by DIC Corporation, Fastogen Blue 8120B) was used instead of the charge generation material used in Example 1. The prepared photoreceptor was left to stand for 30 days in the same manner as in Example 1.

Comparative Example 1

An electrophotographic photoreceptor was prepared in the same manner as in Example 1 except that the compound represented by formula (I-1) above was not added to the charge transport layer. The prepared photoreceptor was left to stand for 30 days in the same manner as in Example 1.

Comparative Example 2

An electrophotographic photoreceptor was prepared in the same manner as in Example 1 except that the compound represented by formula (I-1) above was not added to the charge transport layer and an increased amount, 110 parts by mass of the resin binder was used for the charge transport layer. The prepared photoreceptor was left to stand for 30 days in the same manner as in Example 1.

Comparative Example 3

An electrophotographic photoreceptor was prepared in the same manner as in Example 1 except that the compound represented by formula (I-1) above was not added to the charge transport layer and 10 parts by mass of dioctyl phthalate (produced by Wako Pure Chemical Industries, Ltd.) was added instead. The prepared photoreceptor was left to stand for 30 days in the same manner as in Example 1.

Comparative Example 4

An electrophotographic photoreceptor was prepared in the same manner as in Example 80 except that the compound represented by formula (I-1) above was not used. The prepared photoreceptor was left to stand for 30 days in the same manner as in Example 1.

Comparative Example 5

An electrophotographic photoreceptor was prepared in the same manner as in Example 81 except that the compound represented by formula (I-1) above was not used. The prepared photoreceptor was left to stand for 30 days in the same manner as in Example 1.

Stain Resistance

The photoreceptors prepared in Examples 1 to 81 and Comparative Examples 1 to 5 after keeping the photoreceptors in an environment with temperature of 60° C. and humidity of 90% for 30 days were used for halftone image formation and evaluated according to the following criteria.

O: Streaks were not produced in halftone images x: Streaks were produced in halftone images Electric Characteristics The photoreceptors prepared in Examples 1 to 81 and Comparative Examples 1 to 5 were mounted on a printer LJ4250 produced by HP Inc. containing a charging roller (rubber roller) and a transfer roller (rubber roller) and evaluated according to the following procedure. Namely, the surface of the photoreceptors was charged to −650 V by corona discharge in a dark place and the surface potential V0 was immediately measured thereafter. This was followed by 5 more seconds of corona discharge in a dark place and the surface potential V5 was measured. According to formula (1) below, the potential retention rate Vk5(%) 5 seconds after charging was calculated.

$$Vk5=V5/V0\times 100 \quad (1)$$

Next, using a halogen lamp as a light source, the photoreceptors were irradiated with exposure light dispersed at 780 nm with a filter for 5 seconds after the surface potential reached −600 V and the light exposure E½ ($\mu Jcm^{-2}$) required for light attenuation until the surface potential reached −300 V and the sensitivity as the light exposure E50 ($\mu Jcm^{-2}$) required for light attenuation until the surface potential reached −50 V were determined.

The photoreceptors shown in Examples and Comparative Examples were placed in an ozone exposing device in which photoreceptors can be left to stand in an ozone atmosphere and exposed to ozone at 100 ppm for 2 hours. Thereafter, the potential retention rate as described above was also measured and a degree of change in the retention rate (Vk5) before and after exposure to ozone was determined as the ozone exposure retention change rate (ΔVk5). The ozone exposure retention change rate was determined according to formula (2) below with $Vk5_1$ being the retention rate before exposure to ozone and $Vk5_2$ being the retention rate after exposure to ozone.

$$\Delta Vk5 = Vk5_2 \text{ (after ozone exposure)} / Vk5_1 \text{ (before ozone exposure)} \quad (2)$$

The stain resistance and electric characteristics as the measurement results of the photoreceptors prepared in Examples 1 to 81 and Comparative Example 1 to 5 are shown in the following tables.

TABLE 4

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Example 1 | Y—TiOPc | — | — | I-1 (10) | | II-1 | 92.5 | 0.14 | 1.07 | 94.3 | ○ |
| Example 2 | Y—TiOPc | — | — | I-2 (10) | | II-1 | 93.3 | 0.15 | 0.96 | 95.1 | ○ |
| Example 3 | Y—TiOPc | — | — | I-3 (10) | | II-1 | 96.2 | 0.11 | 1.15 | 97.2 | ○ |
| Example 4 | Y—TiOPc | — | — | I-4 (10) | | II-1 | 93.2 | 0.14 | 1.10 | 97.1 | ○ |
| Example 5 | Y—TiOPc | — | — | I-5 (10) | | II-1 | 95.1 | 0.15 | 1.05 | 98.3 | ○ |
| Example 6 | Y—TiOPc | — | — | I-6 (10) | | II-1 | 93.0 | 0.15 | 0.98 | 96.2 | ○ |
| Example 7 | Y—TiOPc | — | — | I-7 (10) | | II-1 | 94.9 | 0.13 | 1.13 | 94.4 | ○ |
| Example 8 | Y—TiOPc | — | — | I-8 (10) | | II-1 | 94.5 | 0.17 | 0.97 | 92.9 | ○ |
| Example 9 | Y—TiOPc | — | — | I-9 (10) | | II-1 | 94.4 | 0.12 | 1.02 | 96.3 | ○ |
| Example 10 | Y—TiOPc | — | — | I-10 (10) | | II-1 | 94.5 | 0.13 | 1.22 | 95.4 | ○ |
| Example 11 | Y—TiOPc | — | — | I-11 (10) | | II-1 | 93.8 | 0.18 | 1.21 | 98.2 | ○ |
| Example 12 | Y—TiOPc | — | — | I-12 (10) | | II-1 | 95.2 | 0.16 | 1.09 | 95.3 | ○ |
| Example 13 | Y—TiOPc | — | — | I-13 (10) | | II-1 | 94.6 | 0.12 | 1.03 | 95.5 | ○ |
| Example 14 | Y—TiOPc | — | — | I-14 (10) | | II-1 | 96.2 | 0.14 | 1.12 | 96.6 | ○ |
| Example 15 | Y—TiOPc | — | — | I-15 (10) | | II-1 | 94.7 | 0.16 | 0.95 | 95.8 | ○ |
| Example 16 | Y—TiOPc | — | — | I-16 (10) | | II-1 | 94.6 | 0.17 | 1.06 | 96.4 | ○ |
| Example 17 | Y—TiOPc | — | — | I-17 (10) | | II-1 | 93.2 | 0.13 | 1.08 | 95.2 | ○ |
| Example 18 | Y—TiOPc | — | — | I-18 (10) | | II-1 | 96.1 | 0.14 | 1.11 | 98.1 | ○ |
| Example 19 | Y—TiOPc | — | — | I-19 (10) | | II-1 | 93.2 | 0.12 | 0.96 | 96.3 | ○ |
| Example 20 | Y—TiOPc | — | — | I-20 (10) | | II-1 | 96.2 | 0.16 | 1.12 | 94.9 | ○ |
| Example 21 | Y—TiOPc | — | — | I-21 (10) | | II-1 | 94.2 | 0.13 | 0.99 | 95.2 | ○ |
| Example 22 | Y—TiOPc | — | — | I-22 (10) | | II-1 | 94.5 | 0.16 | 1.03 | 96.8 | ○ |
| Example 23 | Y—TiOPc | — | — | I-23 (10) | | II-1 | 95.6 | 0.15 | 1.06 | 96.3 | ○ |
| Example 24 | Y—TiOPc | — | — | I-24 (10) | | II-1 | 93.8 | 0.13 | 1.09 | 96.1 | ○ |
| Example 25 | Y—TiOPc | — | — | I-25 (10) | | II-1 | 95.1 | 0.19 | 1.12 | 95.4 | ○ |
| Example 26 | Y—TiOPc | — | — | I-26 (10) | | II-1 | 94.5 | 0.15 | 1.08 | 95.5 | ○ |

*1 Y—TiOPc represents Y-form titanyl phthalocyanine, α-TIOPc represents α-form titanyl phthalocyanine and X—$H_2$Pc represents X-form metal free phthalocyanine.

TABLE 5

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Example 27 | Y—TiOPc | — | — | I-27 (10) | | II-1 | 93.5 | 0.12 | 1.12 | 95.1 | ○ |
| Example 28 | Y—TiOPc | — | — | I-28 (10) | | II-1 | 94.7 | 0.18 | 0.97 | 96.1 | ○ |
| Example 29 | Y—TiOPc | — | — | I-29 (10) | | II-1 | 95.1 | 0.13 | 1.02 | 94.2 | ○ |
| Example 30 | Y—TiOPc | — | — | I-30 (10) | | II-1 | 94.8 | 0.15 | 1.14 | 98.7 | ○ |
| Example 31 | Y—TiOPc | — | — | I-31 (10) | | II-1 | 93.4 | 0.16 | 1.04 | 94.2 | ○ |
| Example 32 | Y—TiOPc | — | — | I-32 (10) | | II-1 | 95.9 | 0.12 | 0.93 | 97.0 | ○ |
| Example 33 | Y—TiOPc | — | — | I-33 (10) | | II-1 | 92.9 | 0.17 | 1.20 | 95.3 | ○ |
| Example 34 | Y—TiOPc | — | — | I-34 (10) | | II-1 | 93.7 | 0.14 | 0.95 | 94.9 | ○ |
| Example 35 | Y—TiOPc | — | — | I-35 (10) | | II-1 | 94.9 | 0.14 | 1.06 | 95.1 | ○ |
| Example 36 | Y—TiOPc | — | — | I-36 (10) | | II-1 | 95.9 | 0.17 | 1.18 | 96.4 | ○ |
| Example 37 | Y—TiOPc | — | — | I-37 (10) | | II-1 | 94.2 | 0.14 | 1.11 | 96.3 | ○ |
| Example 38 | Y—TiOPc | — | — | I-38 (10) | | II-1 | 96.7 | 0.14 | 1.05 | 96.3 | ○ |
| Example 39 | Y—TiOPc | — | — | I-39 (10) | | II-1 | 94.6 | 0.13 | 1.03 | 95.2 | ○ |
| Example 40 | Y—TiOPc | — | — | I-40 (10) | | II-1 | 95.3 | 0.14 | 1.06 | 96.6 | ○ |
| Example 41 | Y—TiOPc | — | — | I-41 (10) | | II-1 | 94.7 | 0.17 | 0.95 | 94.8 | ○ |
| Example 42 | Y—TiOPc | — | — | I-42 (10) | | II-1 | 96.2 | 0.16 | 1.13 | 96.8 | ○ |
| Example 43 | Y—TiOPc | — | — | I-43 (10) | | II-1 | 92.7 | 0.11 | 0.93 | 94.5 | ○ |
| Example 44 | Y—TiOPc | — | — | I-44 (10) | | II-1 | 96.7 | 0.17 | 1.02 | 96.2 | ○ |

TABLE 5-continued

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Example 45 | Y—TiOPc | — | — | I-45 (10) | | II-1 | 93.2 | 0.15 | 1.10 | 96.1 | ○ |
| Example 46 | Y—TiOPc | — | — | I-46 (10) | | II-1 | 96.4 | 0.15 | 1.04 | 98.2 | ○ |
| Example 47 | Y—TiOPc | — | — | I-47 (10) | | II-1 | 93.2 | 0.12 | 0.98 | 98.2 | ○ |
| Example 48 | Y—TiOPc | — | — | I-48 (10) | | II-1 | 95.7 | 0.16 | 1.13 | 94.8 | ○ |
| Example 49 | Y—TiOPc | — | — | I-49 (10) | | II-1 | 94.2 | 0.12 | 0.99 | 96.2 | ○ |
| Example 50 | Y—TiOPc | — | — | I-50 (10) | | II-1 | 93.6 | 0.16 | 1.13 | 96.7 | ○ |
| Example 51 | Y—TiOPc | — | — | I-51 (10) | | II-1 | 94.3 | 0.15 | 1.20 | 96.4 | ○ |

TABLE 6

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Example 52 | Y—TiOPc | — | — | I-52 (10) | | II-1 | 95.2 | 0.11 | 1.12 | 95.3 | ○ |
| Example 53 | Y—TiOPc | — | — | I-53 (10) | | II-1 | 96.2 | 0.14 | 1.15 | 96.3 | ○ |
| Example 54 | Y—TiOPc | — | — | I-54 (10) | | II-1 | 94.6 | 0.16 | 1.03 | 96.7 | ○ |
| Example 55 | Y—TiOPc | — | — | I-55 (10) | | II-1 | 94.3 | 0.14 | 1.12 | 96.6 | ○ |
| Example 56 | Y—TiOPc | — | — | I-56 (10) | | II-1 | 93.2 | 0.11 | 1.10 | 95.2 | ○ |
| Example 57 | Y—TiOPc | — | — | I-57 (10) | | II-1 | 94.1 | 0.15 | 1.05 | 98.2 | ○ |
| Example 58 | Y—TiOPc | — | — | I-58 (10) | | II-1 | 93.2 | 0.15 | 0.98 | 96.3 | ○ |
| Example 59 | Y—TiOPc | — | — | I-59 (10) | | II-1 | 95.8 | 0.17 | 1.15 | 96.4 | ○ |
| Example 60 | Y—TiOPc | — | — | I-60 (10) | | II-1 | 94.8 | 0.15 | 1.11 | 97.5 | ○ |
| Example 61 | Y—TiOPc | — | — | I-61 (10) | | II-1 | 96.1 | 0.14 | 1.03 | 96.3 | ○ |
| Example 62 | Y—TiOPc | — | — | I-62 (10) | | II-1 | 94.6 | 0.15 | 1.03 | 94.2 | ○ |
| Example 63 | Y—TiOPc | — | — | I-63 (10) | | II-1 | 97.2 | 0.14 | 1.07 | 96.6 | ○ |
| Example 64 | Y—TiOPc | — | — | I-64 (10) | | II-1 | 94.7 | 0.13 | 0.95 | 95.5 | ○ |
| Example 65 | Y—TiOPc | — | — | I-65 (10) | | II-1 | 95.8 | 0.16 | 1.13 | 96.8 | ○ |
| Example 66 | Y—TiOPc | — | — | I-66 (10) | | II-1 | 92.7 | 0.10 | 0.93 | 94.6 | ○ |
| Example 67 | Y—TiOPc | — | — | I-67 (10) | | II-1 | 94.8 | 0.17 | 1.02 | 96.2 | ○ |
| Example 68 | Y—TiOPc | — | — | I-68 (10) | | II-1 | 93.2 | 0.11 | 1.10 | 96.7 | ○ |
| Example 69 | Y—TiOPc | — | — | I-69 (10) | | II-1 | 95.8 | 0.15 | 1.17 | 98.2 | ○ |
| Example 70 | Y—TiOPc | — | — | I-70 (10) | | II-1 | 93.2 | 0.13 | 0.98 | 95.0 | ○ |
| Example 71 | Y—TiOPc | — | — | I-71 (10) | | II-1 | 96.7 | 0.17 | 1.15 | 96.4 | ○ |
| Example 72 | Y—TiOPc | — | — | I-72 (10) | | II-1 | 94.8 | 0.13 | 1.11 | 96.5 | ○ |
| Example 73 | Y—TiOPc | — | — | I-1 (1) | | II-1 | 95.3 | 0.12 | 1.02 | 96.2 | ○ |
| Example 74 | Y—TiOPc | — | — | I-1 (3) | | II-1 | 92.2 | 0.12 | 0.98 | 95.1 | ○ |
| Example 75 | Y—TiOPc | — | — | I-1 (6) | | II-1 | 96.3 | 0.13 | 1.12 | 95.2 | ○ |

TABLE 7

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Example 76 | Y—TiOPc | — | — | — | I-1 (12) | II-1 | 94.2 | 0.10 | 0.99 | 97.0 | ○ |
| Example 77 | Y—TiOPc | I-1 (3) | — | I-1 (3) | | II-1 | 96.5 | 0.16 | 1.08 | 96.8 | ○ |
| Example 78 | Y—TiOPc | — | I-1 (3) | I-1 (3) | | II-1 | 94.7 | 0.17 | 1.06 | 98.8 | ○ |
| Example 79 | Y—TiOPc | I-1 (3) | I-1 (1) | I-1 (3) | | II-1 | 95.6 | 0.17 | 1.16 | 96.4 | ○ |
| Example 80 | α-TiOPc | — | — | I-1 (10) | | II-1 | 94.8 | 0.11 | 1.10 | 96.5 | ○ |
| Example 81 | X—$H_2$Pc | — | — | I-1 (10) | | II-1 | 96.8 | 0.14 | 1.14 | 95.3 | ○ |
| Comparative Example 1 | Y—TiOPc | — | — | — | | II-1 | 93.0 | 0.32 | 2.35 | 78.3 | x |
| Comparative Example 2 | Y—TiOPc | — | — | — | | II-1 | 92.0 | 0.38 | 2.80 | 74.2 | x |
| Comparative Example 3 | Y—TiOPc | — | — | Dioctyl phthalate (10) | | II-1 | 94.4 | 0.27 | 2.98 | 75.5 | x |
| Comparative Example 4 | α-TiOPc | — | — | — | | II-1 | 94.3 | 0.32 | 3.12 | 77.6 | x |

TABLE 7-continued

| | Charge generation material *1 | Additive (parts by mass) Under-coating layer | Charge generation layer | Charge transport layer | Surface protection layer | Charge transport material | Vk5 (%) | E1/2 ($\mu Jcm^{-2}$) | E50 ($\mu Jcm^{-2}$) | Ozone exposure retention change rate ΔVk5 (%) | Stain resistance |
|---|---|---|---|---|---|---|---|---|---|---|---|
| Comparative Example 5 | X—$H_2Pc$ | — | — | — | | II-1 | 94.9 | 0.36 | 2.65 | 75.8 | x |

The results in the above tables revealed that even when the compound according to the present invention was used as an additive of the layers included in the photoreceptors, initial electric characteristics were not significantly affected.

Meanwhile, Comparative Example 2 in which the amount of the resin binder included in the charge transport layer was increased without adding the compound according to the present invention had the sensitivity which was slightly delayed and streaks were produced in the image evaluation of the photoreceptor which was left to stand. This result revealed that the effect exhibited by using the compound according to the present invention could not have been achieved by merely increasing the resin binder for the charge transport layer.

Moreover, significant variation in the initial sensitivity was rarely observed due to usage of the compound according to the present invention even when various phthalocyanines were used as the charge generation material and no streaks were produced in the image evaluation of the photoreceptors which were left to stand.

Next, the photoreceptors prepared in Examples 1 to 81 and Comparative Examples 1 to 5 were mounted on a two-component development digital copying machine (produced by Canon Inc., image Runner color 2880) which was modified to allow measurement of surface potential of the photoreceptor and potential stability before and after printing 100,000 sheets of the copying machine, image memory and the abrasion of the photosensitive layer due to friction with paper and blades were also evaluated. The results are shown in the following respective tables.

The image evaluation was carried out by, in the printing evaluation of an image sample having a checker flag pattern in the anterior half and halftone in the posterior half, judging the presence or absence of a memory phenomenon which corresponds to the checker flag pattern formed in the halftone part. The result was indicated by giving O when memory was not observed, Δ when memory was slightly observed and x when memory was clearly observed, and also giving judgement of (positive) when the light and shade were the same as those in the original image and (negative) when the light and shade were reversed from the original image, namely inversion occurred.

TABLE 8

| | Initial bright part potential (—V) | Initial image memory evaluation | Bright part potential after 100,000 sheets printing (—V) | Bright part potential change rate (—V) | Image memory evaluation after repetitive printing | Abrasion of photosensitive layer before and after printing (μm) |
|---|---|---|---|---|---|---|
| Example 1 | 121 | ○ | 123 | 2 | ○ | 1.96 |
| Example 2 | 125 | ○ | 136 | 11 | ○ | 1.88 |
| Example 3 | 119 | ○ | 122 | 3 | ○ | 1.97 |
| Example 4 | 123 | ○ | 129 | 6 | ○ | 2.0 |
| Example 5 | 119 | ○ | 119 | 0 | ○ | 1.82 |
| Example 6 | 122 | ○ | 123 | 1 | ○ | 1.99 |
| Example 7 | 135 | ○ | 137 | 2 | ○ | 1.91 |
| Example 8 | 135 | ○ | 141 | 6 | ○ | 1.86 |
| Example 9 | 115 | ○ | 121 | 6 | ○ | 1.89 |
| Example 10 | 114 | ○ | 124 | 10 | ○ | 1.99 |
| Example 11 | 117 | ○ | 126 | 9 | ○ | 1.86 |
| Example 12 | 123 | ○ | 135 | 12 | ○ | 2.01 |
| Example 13 | 128 | ○ | 132 | 4 | ○ | 2.02 |
| Example 14 | 119 | ○ | 123 | 4 | ○ | 1.99 |
| Example 15 | 115 | ○ | 122 | 7 | ○ | 1.82 |
| Example 16 | 136 | ○ | 137 | 1 | ○ | 1.95 |
| Example 17 | 134 | ○ | 139 | 5 | ○ | 1.89 |
| Example 18 | 112 | ○ | 126 | 14 | ○ | 1.86 |
| Example 19 | 124 | ○ | 133 | 9 | ○ | 2.04 |
| Example 20 | 132 | ○ | 132 | 0 | ○ | 2.01 |
| Example 21 | 132 | ○ | 140 | 8 | ○ | 2.11 |
| Example 22 | 118 | ○ | 123 | 5 | ○ | 1.86 |
| Example 23 | 127 | ○ | 128 | 1 | ○ | 1.96 |
| Example 24 | 122 | ○ | 132 | 10 | ○ | 2.0 |
| Example 25 | 116 | ○ | 123 | 7 | ○ | 1.95 |
| Example 26 | 117 | ○ | 122 | 5 | ○ | 1.88 |

TABLE 9

| | Initial bright part potential (—V) | Initial image memory evaluation | Bright part potential after 100,000 sheets printing (—V) | Bright part potential change rate (—V) | Image memory evaluation after repetitive printing | Abrasion of photosensitive layer before and after printing (μm) |
|---|---|---|---|---|---|---|
| Example 27 | 128 | ○ | 131 | 3 | ○ | 1.99 |
| Example 28 | 132 | ○ | 139 | 7 | ○ | 2.02 |
| Example 29 | 119 | ○ | 121 | 2 | ○ | 2.04 |
| Example 30 | 127 | ○ | 134 | 7 | ○ | 1.98 |
| Example 31 | 125 | ○ | 132 | 7 | ○ | 2.01 |
| Example 32 | 133 | ○ | 136 | 3 | ○ | 2.04 |
| Example 33 | 132 | ○ | 140 | 8 | ○ | 2.02 |
| Example 34 | 126 | ○ | 131 | 5 | ○ | 2.06 |
| Example 35 | 125 | ○ | 135 | 10 | ○ | 1.95 |
| Example 36 | 122 | ○ | 129 | 7 | ○ | 2.04 |
| Example 37 | 119 | ○ | 122 | 3 | ○ | 2.08 |
| Example 38 | 123 | ○ | 134 | 11 | ○ | 1.86 |
| Example 39 | 119 | ○ | 119 | 0 | ○ | 1.94 |
| Example 40 | 122 | ○ | 123 | 1 | ○ | 1.97 |
| Example 41 | 135 | ○ | 137 | 2 | ○ | 2.0 |
| Example 42 | 135 | ○ | 141 | 6 | ○ | 2.01 |
| Example 43 | 112 | ○ | 124 | 12 | ○ | 2.03 |
| Example 44 | 125 | ○ | 137 | 12 | ○ | 2.06 |
| Example 45 | 125 | ○ | 131 | 6 | ○ | 1.93 |
| Example 46 | 132 | ○ | 132 | 0 | ○ | 2.02 |
| Example 47 | 132 | ○ | 140 | 8 | ○ | 1.99 |
| Example 48 | 118 | ○ | 123 | 5 | ○ | 1.89 |
| Example 49 | 127 | ○ | 128 | 1 | ○ | 2.03 |
| Example 50 | 118 | ○ | 121 | 3 | ○ | 2.01 |
| Example 51 | 123 | ○ | 139 | 16 | ○ | 2.01 |

TABLE 10

| | Initial bright part potential (—V) | Initial image memory evaluation | Bright part potential after 100,000 sheets printing (—V) | Bright part potential change rate (—V) | Image memory evaluation after repetitive printing | Abrasion of photosensitive layer before and after printing (μm) |
|---|---|---|---|---|---|---|
| Example 52 | 128 | ○ | 132 | 4 | ○ | 1.95 |
| Example 53 | 119 | ○ | 119 | 0 | ○ | 1.89 |
| Example 54 | 122 | ○ | 123 | 1 | ○ | 1.94 |
| Example 55 | 135 | ○ | 137 | 2 | ○ | 2.01 |
| Example 56 | 135 | ○ | 141 | 6 | ○ | 2.02 |
| Example 57 | 112 | ○ | 124 | 12 | ○ | 1.92 |
| Example 58 | 125 | ○ | 137 | 12 | ○ | 2.06 |
| Example 59 | 125 | ○ | 131 | 6 | ○ | 2.01 |
| Example 60 | 132 | ○ | 132 | 0 | ○ | 2.03 |
| Example 61 | 132 | ○ | 140 | 8 | ○ | 1.88 |
| Example 62 | 118 | ○ | 123 | 5 | ○ | 1.89 |
| Example 63 | 127 | ○ | 128 | 1 | ○ | 2.02 |
| Example 64 | 122 | ○ | 132 | 10 | ○ | 2.01 |
| Example 65 | 116 | ○ | 123 | 7 | ○ | 2.05 |
| Example 66 | 117 | ○ | 122 | 5 | ○ | 1.92 |
| Example 67 | 131 | ○ | 137 | 6 | ○ | 1.93 |
| Example 68 | 133 | ○ | 134 | 1 | ○ | 1.88 |
| Example 69 | 114 | ○ | 124 | 10 | ○ | 1.96 |
| Example 70 | 127 | ○ | 132 | 5 | ○ | 2.04 |
| Example 71 | 125 | ○ | 132 | 7 | ○ | 2.0 |
| Example 72 | 131 | ○ | 132 | 1 | ○ | 1.91 |
| Example 73 | 123 | ○ | 133 | 10 | ○ | 1.94 |
| Example 74 | 116 | ○ | 122 | 6 | ○ | 1.88 |
| Example 75 | 122 | ○ | 136 | 14 | ○ | 1.97 |

TABLE 11

| | Initial bright part potential (—V) | Initial image memory evaluation | Bright part potential after 100,000 sheets printing (—V) | Bright part potential change rate (—V) | Image memory evaluation after repetitive printing | Abrasion of photosensitive layer before and after printing (μm) |
|---|---|---|---|---|---|---|
| Example 76 | 134 | ○ | 142 | 8 | ○ | 1.88 |
| Example 77 | 114 | ○ | 125 | 11 | ○ | 1.98 |

TABLE 11-continued

| | Initial bright part potential (—V) | Initial image memory evaluation | Bright part potential after 100,000 sheets printing (—V) | Bright part potential change rate (—V) | Image memory evaluation after repetitive printing | Abrasion of photosensitive layer before and after printing (μm) |
|---|---|---|---|---|---|---|
| Example 78 | 127 | ○ | 131 | 4 | ○ | 1.85 |
| Example 79 | 126 | ○ | 133 | 7 | ○ | 1.89 |
| Example 80 | 130 | ○ | 132 | 2 | ○ | 2.01 |
| Example 81 | 126 | ○ | 130 | 4 | ○ | 1.96 |
| Comparative Example 1 | 132 | ○ | 146 | 14 | ○ | 4.32 |
| Comparative Example 2 | 131 | ○ | 145 | 14 | ○ | 4.56 |
| Comparative Example 3 | 125 | ○ | 131 | 6 | ○ | 4.35 |
| Comparative Example 4 | 222 | ○ | 229 | 7 | ○ | 4.29 |
| Comparative Example 5 | 235 | ○ | 252 | 17 | ○ | 4.39 |

The results in the above tables revealed that by adding the compound according to the present invention to the layers, there was no significant difference observed in the initial real machine electric characteristics compared to the case without addition of the compound. Moreover, there was no problem observed in the potential after printing and the evaluations of images.

Next, potential characteristics of photoreceptors in the digital copying machine were examined according to the operation environments from low temperature and low humidity to high temperature and high humidity and at the same time image evaluation was carried out. Namely, under respective temperature and humidity conditions, using a halogen lamp as a light source, the photoreceptors were irradiated with exposure light dispersed at 780 nm with a filter for 5 seconds after the surface potential reached −600 V and the residual potential (−V) which was the surface potential after irradiation of 5 seconds was measured. At the same time, image evaluation under low temperature and low humidity and high temperature and high humidity was carried out in the same manner as described above. The results are shown in the following tables.

TABLE 12

| | Low temperature and low humidity *2 (—V) | Normal temperature and normal humidity *3 (—V) | High temperature and high humidity *4 (—V) | Residual potential change rate between low temperature and low humidity and high temperature and high humidity (—V) | Memory evaluation at high temperature and high humidity | Memory evaluation at low temperature and low humidity |
|---|---|---|---|---|---|---|
| Example 1 | 165 | 122 | 80 | 85 | ○ | ○ |
| Example 2 | 151 | 149 | 83 | 68 | ○ | ○ |
| Example 3 | 163 | 157 | 121 | 42 | ○ | ○ |
| Example 4 | 172 | 145 | 100 | 72 | ○ | ○ |
| Example 5 | 157 | 128 | 75 | 82 | ○ | ○ |
| Example 6 | 162 | 126 | 71 | 91 | ○ | ○ |
| Example 7 | 155 | 126 | 68 | 87 | ○ | ○ |
| Example 8 | 151 | 147 | 65 | 86 | ○ | ○ |
| Example 9 | 165 | 132 | 88 | 77 | ○ | ○ |
| Example 10 | 152 | 122 | 72 | 80 | ○ | ○ |
| Example 11 | 155 | 122 | 75 | 80 | ○ | ○ |
| Example 12 | 148 | 132 | 68 | 80 | ○ | ○ |
| Example 13 | 149 | 113 | 76 | 73 | ○ | ○ |
| Example 14 | 143 | 118 | 52 | 91 | ○ | ○ |
| Example 15 | 139 | 122 | 56 | 83 | ○ | ○ |
| Example 16 | 148 | 121 | 62 | 86 | ○ | ○ |
| Example 17 | 143 | 132 | 68 | 75 | ○ | ○ |
| Example 18 | 151 | 113 | 66 | 85 | ○ | ○ |
| Example 19 | 150 | 126 | 76 | 74 | ○ | ○ |
| Example 20 | 161 | 125 | 70 | 91 | ○ | ○ |
| Example 21 | 158 | 131 | 83 | 75 | ○ | ○ |
| Example 22 | 152 | 142 | 81 | 71 | ○ | ○ |
| Example 23 | 161 | 148 | 76 | 85 | ○ | ○ |
| Example 24 | 163 | 153 | 64 | 99 | ○ | ○ |
| Example 25 | 159 | 119 | 83 | 76 | ○ | ○ |
| Example 26 | 175 | 145 | 100 | 75 | ○ | ○ |

*2 Temperature: 5° C., humidity: 10%

*3 Temperature: 25° C., humidity: 50%

*4 Temperature: 35° C., humidity: 85%

TABLE 13

| | Low temperature and low humidity *2 (—V) | Normal temperature and normal humidity *3 (—V) | High temperature and high humidity *4 (—V) | Residual potential change rate between low temperature and low humidity and high temperature and high humidity (—V) | Memory evaluation at high temperature and high humidity | Memory evaluation at low temperature and low humidity |
|---|---|---|---|---|---|---|
| Example 27 | 156 | 121 | 78 | 78 | ○ | ○ |
| Example 28 | 162 | 135 | 90 | 72 | ○ | ○ |
| Example 29 | 153 | 140 | 81 | 72 | ○ | ○ |
| Example 30 | 171 | 162 | 125 | 46 | ○ | ○ |
| Example 31 | 183 | 145 | 100 | 83 | ○ | ○ |
| Example 32 | 167 | 125 | 78 | 89 | ○ | ○ |
| Example 33 | 163 | 138 | 71 | 92 | ○ | ○ |
| Example 34 | 178 | 118 | 92 | 86 | ○ | ○ |
| Example 35 | 167 | 143 | 64 | 103 | ○ | ○ |
| Example 36 | 168 | 114 | 86 | 82 | ○ | ○ |
| Example 37 | 161 | 153 | 64 | 97 | ○ | ○ |
| Example 38 | 158 | 119 | 83 | 75 | ○ | ○ |
| Example 39 | 157 | 123 | 87 | 70 | ○ | ○ |
| Example 40 | 161 | 128 | 96 | 65 | ○ | ○ |
| Example 41 | 152 | 121 | 101 | 51 | ○ | ○ |
| Example 42 | 151 | 121 | 72 | 79 | ○ | ○ |
| Example 43 | 156 | 121 | 78 | 78 | ○ | ○ |
| Example 44 | 147 | 126 | 76 | 71 | ○ | ○ |
| Example 45 | 151 | 126 | 68 | 83 | ○ | ○ |
| Example 46 | 158 | 147 | 65 | 93 | ○ | ○ |
| Example 47 | 162 | 132 | 88 | 74 | ○ | ○ |
| Example 48 | 151 | 122 | 72 | 79 | ○ | ○ |
| Example 49 | 158 | 122 | 75 | 83 | ○ | ○ |
| Example 50 | 139 | 122 | 56 | 83 | ○ | ○ |
| Example 51 | 142 | 121 | 62 | 80 | ○ | ○ |

TABLE 14

| | Low temperature and low humidity *2 (—V) | Normal temperature and normal humidity *3 (—V) | High temperature and high humidity *4 (—V) | Residual potential change rate between low temperature and low humidity and high temperature and high humidity (—V) | Memory evaluation at high temperature and high humidity | Memory evaluation at low temperature and low humidity |
|---|---|---|---|---|---|---|
| Example 52 | 165 | 162 | 125 | 40 | ○ | ○ |
| Example 53 | 152 | 142 | 56 | 96 | ○ | ○ |
| Example 54 | 157 | 129 | 76 | 81 | ○ | ○ |
| Example 55 | 168 | 126 | 80 | 88 | ○ | ○ |
| Example 56 | 161 | 135 | 73 | 88 | ○ | ○ |
| Example 57 | 156 | 128 | 76 | 80 | ○ | ○ |
| Example 58 | 172 | 114 | 96 | 76 | ○ | ○ |
| Example 59 | 148 | 130 | 72 | 76 | ○ | ○ |
| Example 60 | 146 | 132 | 65 | 81 | ○ | ○ |
| Example 61 | 151 | 117 | 68 | 83 | ○ | ○ |
| Example 62 | 149 | 132 | 68 | 81 | ○ | ○ |
| Example 63 | 159 | 113 | 72 | 87 | ○ | ○ |
| Example 64 | 153 | 143 | 56 | 97 | ○ | ○ |
| Example 65 | 165 | 125 | 83 | 82 | ○ | ○ |
| Example 66 | 165 | 123 | 80 | 85 | ○ | ○ |
| Example 67 | 152 | 119 | 75 | 77 | ○ | ○ |
| Example 68 | 173 | 121 | 84 | 89 | ○ | ○ |
| Example 69 | 157 | 132 | 87 | 70 | ○ | ○ |
| Example 70 | 148 | 129 | 54 | 94 | ○ | ○ |
| Example 71 | 152 | 125 | 75 | 77 | ○ | ○ |
| Example 72 | 159 | 113 | 72 | 87 | ○ | ○ |
| Example 73 | 147 | 122 | 86 | 61 | ○ | ○ |
| Example 74 | 156 | 135 | 62 | 94 | ○ | ○ |
| Example 75 | 153 | 147 | 75 | 78 | ○ | ○ |

TABLE 15

| | Low temperature and low humidity *2 (—V) | Normal temperature and normal humidity *3 (—V) | High temperature and high humidity *4 (—V) | Residual potential change rate between low temperature and low humidity and high temperature and high humidity (—V) | Memory evaluation at high temperature and high humidity | Memory evaluation at low temperature and low humidity |
|---|---|---|---|---|---|---|
| Example 76 | 156 | 118 | 85 | 71 | ○ | ○ |
| Example 77 | 139 | 116 | 54 | 85 | ○ | ○ |
| Example 78 | 158 | 112 | 86 | 72 | ○ | ○ |
| Example 79 | 161 | 122 | 89 | 72 | ○ | ○ |
| Example 80 | 154 | 124 | 80 | 74 | ○ | ○ |
| Example 81 | 148 | 122 | 58 | 90 | ○ | ○ |
| Comparative Example 1 | 198 | 136 | 78 | 120 | Δ (positive) | x (negative) |
| Comparative Example 2 | 187 | 135 | 67 | 120 | Δ (positive) | x (negative) |
| Comparative Example 3 | 232 | 128 | 92 | 140 | Δ (positive) | x (negative) |
| Comparative Example 4 | 265 | 221 | 113 | 152 | Δ (positive) | x (negative) |
| Comparative Example 5 | 298 | 289 | 127 | 171 | Δ (positive) | x (negative) |

The results in the above tables revealed that by using the compound according to the present invention, the environment dependence of the potential and image was reduced and particularly the memory under low temperature and low humidity was significantly improved.

Production Examples of Positive-Charged Single Layer Photoreceptors

Example 82

Onto an outer circumference of an aluminium cylinder having an outer diameter of ϕ 24 mm serving as a conductive substrate was applied by dip coating a coating liquid prepared by dissolving/dispersing 5 parts by mass of an alcohol soluble nylon (product name: "Amilan CM8000", produced by Toray Industries, Inc.) and 5 parts by mass of titanium oxide microparticles subjected to amino silane treatment in 90 parts by mass of methanol, followed by drying at a temperature of 100° C. for 30 minutes to form an under-coating layer having a film thickness of about 2 μm.

A coating liquid was prepared by dissolving 7.0 parts by mass of the styryl compound represented by formula (II-12) above as a hole transport material, 3 parts by mass of the compound represented by formula (III-1) below as an electron transport material, 9.6 parts by mass of a polycarbonate resin (product name "Panlite TS-2050", produced by Teijin Chemicals Ltd.) as a resin binder, 0.04 parts by mass of silicone oil (product name "KF-54", produced by Shin-Etsu Polymer Co., Ltd.) and 1.5 parts by mass of the compound represented by formula (I-1) above in 100 parts by mass of methylene chloride, adding 0.3 parts by mass of X-form metal free phthalocyanine disclosed in U.S. Pat. No. 3,357,989 as a charge generation material, and then carrying out dispersing treatment in a sand grind mill. A coating film was formed with the coating liquid on the under-coating layer and dried at a temperature of 100° C. for 60 minutes to form a single-layer photosensitive layer having a film thickness of about 25 μm, thereby giving a positive-charged single layer electrophotographic photoreceptor. The prepared photoreceptor was brought into contact with a charging roller (rubber roller) and a transfer roller (rubber roller) mounted on a printer HL-2040 produced by Brother Industries, Ltd. and left to stand in an environment with temperature of 60° C. and humidity of 90% for 30 days.

(III-1)

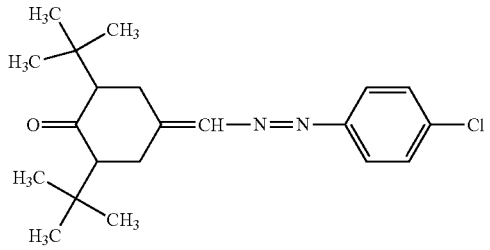

Examples 83-86

Electrophotographic photoreceptors were prepared in the same manner as in Example 82 except that the compounds represented by structural formulae (I-5), (I-25), (I-33) and (I-49) above were respectively used instead of the compound represented by formula (I-1) above used in Example 82. The prepared photoreceptors were left to stand for 30 days in the same manner as in Example 82.

Comparative Example 6

An electrophotographic photoreceptor was prepared in the same manner as in Example 82 except that the compound represented by formula (I-1) above was not used. The prepared photoreceptor was left to stand for 30 days in the same manner as in Example 82.

Comparative Example 7

An electrophotographic photoreceptor was prepared in the same manner as in Example 82 except that dioctyl phthalate (produced by Wako Pure Chemical Industries, Ltd.) was used instead of the compound represented by formula (I-1) above used in Example 82. The prepared photoreceptor was left to stand for 30 days in the same manner as in Example 82.

Stain Resistance

The photoreceptors prepared in Examples 82 to 86 and Comparative Examples 6 and 7 after keeping the photoreceptors in an environment with temperature of 60° C. and humidity of 90% for 30 days were used for halftone image formation and evaluated according to the following criteria.

O: Streaks were not produced in halftone images
x: Streaks were produced in halftone images Electric Characteristics The photoreceptors prepared in Examples 82 to 86 and Comparative Examples 6 and 7 were mounted on a printer HL-2040 produced by Brother Industries, Ltd. containing a charging roller (rubber roller) and a transfer roller (rubber roller) and evaluated according to the following procedure. Namely, the surface of the photoreceptors was charged to +650 V by corona discharge in a dark place and the surface potential V0 was immediately measured thereafter. The photoreceptors were left to stand in a dark place for 5 seconds and the surface potential V5 was measured. According to formula (1) below, the potential retention rate Vk5(%) 5 seconds after charging was calculated.

$$Vk5=V5/V0\times100 \quad (1)$$

Next, using a halogen lamp as a light source, the photoreceptors were irradiated with exposure light of 1.0 μW/cm$^2$ dispersed at 780 nm with a filter for 5 seconds after the surface potential reached +600 V and the light exposure E½ (μJcm$^{-2}$) required for light attenuation until the surface potential reached +300V and the sensitivity as the light exposure E50 (μJcm$^{-2}$) required for light attenuation until the surface potential reached +50V were determined.

The photoreceptors prepared in Examples 82 to 86 and Comparative Examples 6 and 7 were placed in an ozone exposing device in which photoreceptors can be left to stand in an ozone atmosphere and exposed to ozone at 100 ppm for 2 hours. Thereafter, the potential retention rate as described above was measured again and a degree of change in the retention rate Vk5 before and after exposure to ozone was determined as the ozone exposure retention change rate (ΔVk5). The ozone exposure retention change rate is determined according to formula (2) below with $Vk5_1$ being the retention rate before exposure to ozone and $Vk5_2$ being the retention rate after exposure to ozone.

$$\Delta Vk5=Vk5_2\text{ (after ozone exposure)}/Vk5_1\text{ (before ozone exposure)} \quad (2)$$

The stain resistance and electric characteristics as the measurement results of the photoreceptors prepared in Examples 82 to 86 and Comparative Examples 6 and 7 are shown in the following table.

TABLE 16

| | Charge generation material *5 | Additive (parts by mass) | Hole transport material | Electron transport material | Vk5 (%) | E1/2 (μJcm$^{-2}$) | E50 (μJcm$^{-2}$) | Ozone exposure retention change rate (ΔVk5) (%) | Stain resistance |
|---|---|---|---|---|---|---|---|---|---|
| Example 82 | X—$H_2$PC | I-1 (1.5) | II-12 | III-1 | 86.9 | 0.42 | 2.11 | 90.2 | ○ |
| Example 83 | X—$H_2$PC | I-5 (1.5) | II-12 | III-1 | 87.2 | 0.39 | 2.27 | 92.3 | ○ |
| Example 84 | X—$H_2$PC | I-25 (1.5) | II-12 | III-1 | 84.3 | 0.52 | 2.40 | 95.5 | ○ |
| Example 85 | X—$H_2$PC | I-33 (1.5) | II-12 | III-1 | 87.3 | 0.48 | 2.31 | 96.1 | ○ |
| Example 86 | X—$H_2$PC | I-49 (1.5) | II-12 | III-1 | 85.8 | 0.43 | 2.38 | 95.3 | ○ |
| Comparative Example 6 | X—$H_2$PC | — | II-12 | III-1 | 86.6 | 0.53 | 2.62 | 75.1 | x |
| Comparative Example 7 | X—$H_2$PC | Dioctyl phthalate (1.5) | II-12 | III-1 | 86.7 | 0.55 | 2.74 | 73.5 | x |

*5 X—$H_2$Pc represents X-form metal free phthalocyanine.

The results in the above table revealed that even when the compound according to the present invention was used as an additive of the layers, initial electric characteristics were not significantly affected and penetration of components exuded from the constituents of a charging roller and a transfer roller was prevented.

Next, the photoreceptors prepared in Examples 82 to 86 and Comparative Examples 6 and 7 were mounted on a printer HL-2040 produced by Brother Industries, Ltd. which was modified to allow measurement of surface potential of the photoreceptor and potential stability before and after printing 10,000 sheets of the printer, image memory and the abrasion of the photosensitive layer due to friction with paper and blades were also evaluated. The results are respectively shown in the following table.

The image evaluation was carried out by, in the printing evaluation of an image sample having a checker flag pattern in the anterior half and halftone in the posterior half, judging the presence or absence of a memory phenomenon which corresponds to the checker flag pattern formed in the halftone part. The result was indicated by giving O when memory was not observed, Δ when memory was slightly observed and x when memory was clearly observed, and also giving judgement of (positive) when the light and shade were the same as those in the original image and (negative) when the light and shade were reversed from the original image, namely inversion occurred.

TABLE 17

| | Initial bright part potential (V) | Initial image memory evaluation | Bright part potential after 10,000 sheets printing (V) | Bright part potential change rate (V) | Image memory evaluation after repetitive printing | Abrasion of photosensitive layer before and after printing (μm) |
|---|---|---|---|---|---|---|
| Example82 | 122 | ○ | 133 | 11 | ○ | 1.98 |
| Example 83 | 131 | ○ | 147 | 16 | ○ | 1.89 |
| Example 84 | 128 | ○ | 137 | 9 | ○ | 1.95 |
| Example 85 | 115 | ○ | 128 | 13 | ○ | 1.88 |
| Example 86 | 123 | ○ | 134 | 11 | ○ | 2.01 |
| Comparative Example 6 | 139 | ○ | 158 | 19 | ○ | 4.56 |
| Comparative Example 7 | 137 | ○ | 154 | 17 | ○ | 4.68 |

The results in the above tables revealed that by adding the compound according to the present invention to the layers, there was no significant difference observed in the initial real machine electric characteristics compared to the case without addition of the compound. Moreover, there was no problem observed in the potential after printing and the evaluations of images.

Next, potential characteristics of photoreceptors in the printer were examined according to the operation environments from low temperature and low humidity to high temperature and high humidity and at the same time image evaluation was carried out. Namely, under respective temperature and humidity conditions, using a halogen lamp as a light source, the photoreceptors were irradiated with exposure light of 1.0 μW/cm$^2$ dispersed at 780 nm with a filter for 5 seconds after the surface potential reached +600 V and the residua potential (V) which was the surface potential after irradiation of 5 seconds was measured. At the same time, image evaluation under low temperature and low humidity and high temperature and high humidity was carried out in the same manner as described above. The results are shown in the following table.

TABLE 18

| | Low temperature and low humidity *2 (V) | Normal temperature and normal humidity *3 (V) | High temperature and high humidity *4 (V) | Residual potential change rate between low temperature and low humidity and high temperature and high humidity (V) | Memory evaluation at high temperature and high humidity | Memory evaluation at low temperature and low humidity |
|---|---|---|---|---|---|---|
| Example 82 | 163 | 134 | 80 | 83 | ○ | ○ |
| Example 83 | 168 | 140 | 82 | 86 | ○ | ○ |
| Example 84 | 158 | 156 | 98 | 60 | ○ | ○ |
| Example 85 | 177 | 147 | 101 | 76 | ○ | ○ |
| Example 86 | 167 | 138 | 92 | 75 | ○ | ○ |
| Comparative Example 6 | 178 | 132 | 61 | 117 | Δ (positive) | x (negative) |
| Comparative Example 7 | 184 | 139 | 59 | 125 | Δ (positive) | x (negative) |

The results in the above table revealed that by using the compound according to the present invention, the environment dependence of the potential and image was reduced and particularly the memory under low temperature and low humidity was significantly improved.

Production of Positive Charge Stacked Photoreceptor

Example 87

A coating liquid was prepared by dissolving 50 parts by mass of the compound represented by formula (II-15) above as a charge transport material and 50 parts by mass of a polycarbonate resin (product name "Panlite TS-2050", produced by Teijin Chemicals Ltd.) as a resin binder in 800 parts by mass of dichloromethane. Onto an outer circumference of an aluminium cylinder having an outer diameter of 24 mm serving as a conductive substrate was applied by dip coating the coating liquid, followed by drying at a temperature of 120° C. for 60 minutes to form a charge transport layer having a film thickness of 15 μm.

Onto the charge transport layer was applied by dip coating a coating liquid prepared by dissolving/dispersing 1.5 parts by mass of X-form metal free phthalocyanine disclosed in U.S. Pat. No. 3,357,989 as a charge generation material, 10 parts by mass of the stilbene compound represented by formula (II-15) above as a hole transport material, 25 parts by mass of the compound represented by formula (III-1) above as an electron transport material, 60 parts by mass of a polycarbonate resin (product name "Panlite TS-2050", produced by Teijin Chemicals Ltd.) as a resin binder and 1.5 parts by mass of the compound represented by formula (I-1)

above in 800 parts by mass of 1,2-dichloroethane, followed by drying at a temperature of 100° C. for 60 minutes to form a photosensitive layer having a film thickness of 15 μm, thereby preparing a positive charge stacked photoreceptor. The prepared photoreceptor was brought into contact with a charging roller (rubber roller) and a transfer roller (rubber roller) mounted on a printer HL-2040 produced by Brother Industries, Ltd. and left to stand in an environment with temperature of 60° C. and humidity of 90% for 30 days.

Example 88

A coating liquid was prepared by dissolving 50 parts by mass of the compound represented by formula (II-15) above as a charge transport material, 50 parts by mass of a polycarbonate resin (product name "Panlite TS-2050", produced by Teijin Chemicals Ltd.) as a resin binder and 1.5 parts by mass of the compound represented by formula (I-1) above in 800 parts by mass of dichloromethane. Onto an outer circumference of an aluminium cylinder having an outer diameter of 24 mm serving as a conductive substrate was applied by dip coating the coating liquid, followed by drying at a temperature of 120° C. for 60 minutes to form a charge transport layer having a film thickness of 15 μm.

Comparative Example 8

An electrophotographic photoreceptor was prepared in the same manner as in Example 87 except that the compound represented by formula (I-1) above was not used. The prepared photoreceptor was left to stand for 30 days in the same manner as in Example 87.

Comparative Example 9

An electrophotographic photoreceptor was prepared in the same manner as in Example 88 except that dioctyl phthalate (Wako Pure Chemical Industries, Ltd.) was used instead of the compound represented by formula (I-1) above used in Example 88. The prepared photoreceptor was left to stand for 30 days in the same manner as in Example 88.

The photoreceptors prepared in Examples 87 and 88 and Comparative Examples 8 and 9 were evaluated in the same manner as in Example 82 and the like.

The stain resistance and electric characteristics as the measurement results of the photoreceptors prepared in Examples 87 and 88 and Comparative Examples 8 and 9 are shown in the following table.

TABLE 19

| | | Additive (parts by mass) | | | | | | | Ozone exposure | |
|---|---|---|---|---|---|---|---|---|---|---|
| | Charge generation material *6 | Charge transport layer | Charge generation layer | Hole transport material | Electron transport material | Vk5 (%) | E1/2 ($\mu Jcm^{-2}$) | E50 ($\mu Jcm^{-2}$) | retention change rate ΔVk5 (%) | Stain resistance |
| Example 87 | X—$H_2$PC | — | I-1 (1.5) | II-15 | III-1 | 86.7 | 0.35 | 2.12 | 98.2 | ○ |
| Example 88 | X—$H_2$PC | I-1 (1.5) | I-1 (1.5) | II-15 | III-1 | 88.2 | 0.36 | 2.21 | 96.7 | ○ |
| Comparative Example 8 | X—$H_2$PC | — | — | II-15 | III-1 | 84.1 | 0.58 | 2.67 | 75.1 | x |
| Comparative Example 9 | X—$H_2$PC | Dioctyl phthalate (1.5) | Dioctyl phthalate (1.5) | II-15 | III-1 | 85.9 | 0.54 | 2.82 | 77.6 | x |

*6 X—$H_2$Pc represents X-form metal free phthalocyanine.

Onto the charge transport layer was applied by dip coating a coating liquid prepared by dissolving/dispersing 1.5 parts by mass of X-form metal free phthalocyanine disclosed in U.S. Pat. No. 3,357,989 as a charge generation material, 10 parts by mass of the stilbene compound represented by formula (II-15) above as a hole transport material, 25 parts by mass of the compound represented by formula (III-1) above as an electron transport material, 60 parts by mass of a polycarbonate resin (product name "Panlite TS-2050", produced by Teijin Chemicals Ltd.) as a resin binder and 1.5 parts by mass of the compound represented by formula (I-1) above in 800 parts by mass of 1,2-dichloroethane, followed by drying at a temperature of 100° C. for 60 minutes to form a photosensitive layer having a film thickness of 15 μm, thereby preparing a positive charge stacked photoreceptor. The prepared photoreceptor was left to stand for 30 days in the same manner as in Example 87.

The results in the above table revealed that even when the compound according to the present invention was used as an additive of the layers, initial electric characteristics were not significantly affected and penetration of components exuded from the constituents of a charging roller and a transfer roller was prevented.

Next, the photoreceptors prepared in Examples 87 and 88 and Comparative Examples 8 and 9 were mounted on a printer HL-2040 produced by Brother Industries, Ltd. which was modified to allow measurement of surface potential of the photoreceptor and potential stability before and after printing 10,000 sheets of the printer, image memory and the abrasion of the photosensitive layer due to friction with paper and blades were also evaluated. The results are respectively shown in the following table.

The image evaluation was carried out in the same manner as in Example 82 and the like.

TABLE 20

| | Initial bright part potential (V) | Initial image memory evaluation | Bright part potential after 10,000 sheets printing (V) | Bright part potential change rate (V) | Image memory evaluation after repetitive printing | Abrasion of photosensitive layer before and after printing (μm) |
|---|---|---|---|---|---|---|
| Example 87 | 114 | ○ | 122 | 8 | ○ | 1.92 |
| Example 88 | 119 | ○ | 126 | 7 | ○ | 2.05 |
| Comparative Example 8 | 145 | ○ | 151 | 6 | ○ | 4.46 |
| Comparative Example 9 | 141 | ○ | 149 | 8 | ○ | 4.63 |

The results in the above table revealed that by adding the compound according to the present invention to the layers, there was no significant difference observed in the initial real machine electric characteristics compared to the case without addition of the compound. Moreover, there was no problem observed in the potential after printing and the evaluations of images.

Next, in the same manner as in Example 82 and the like, potential characteristics of photoreceptors in the printer were examined according to the operation environments from low temperature and low humidity to high temperature and high humidity and at the same time image evaluation was carried out. The results are shown in the following table.

TABLE 21

| | Low temperature and low humidity *2 (V) | Normal temperature and normal humidity *3 (V) | High temperature and high humidity *4 (V) | Residual potential change rate between low temperature and low humidity and high temperature and high humidity (V) | Memory evaluation at high temperature and high humidity | Memory evaluation at low temperature and low humidity |
|---|---|---|---|---|---|---|
| Example 87 | 158 | 125 | 85 | 73 | ○ | ○ |
| Example 88 | 161 | 131 | 92 | 69 | ○ | ○ |
| Comparative Example 8 | 167 | 145 | 54 | 113 | Δ (positive) | x (negative) |
| Comparative Example 9 | 171 | 141 | 52 | 119 | Δ (positive) | x (negative) |

The results in the above table revealed that by using the compound according to the present invention, the environment dependence of the potential and image was reduced and particularly the memory under low temperature and low humidity was significantly improved.

As demonstrated above, the electrophotographic photoreceptor of the present invention exhibits sufficient effects regardless of various processes including various charging processes, developing processes, negative charging and positive charging processes of photoreceptors. As a result, it was demonstrated that according to the present invention, by using a specific compound as an additive to an electrophotographic photoreceptor, it is possible to obtain an electrophotographic photoreceptor which has stable electric characteristics during initial state and repetitive operations and under various operating environments and does not cause image defects such as image memory under various conditions.

What is claimed is:

1. An electrophotographic photoreceptor, comprising:

a conductive substrate; and a photosensitive layer provided on the conductive substrate, wherein an outermost layer contains a compound having a structure represented by general formula (I) below:

(I)

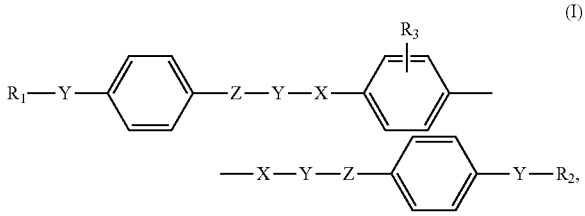

where $R_1$ and $R_2$ each independently represent a $C_{1-12}$ alkyl group or a $C_{5-12}$ cycloalkyl group; $R_3$ represents a hydrogen atom, a halogen atom, a substituted or unsubstituted $C_{1-6}$ alkyl group, a substituted or unsubstituted $C_{1-6}$ alkoxyl group, a $C_{6-20}$ aryl group or a heterocycle group; X and Z each represent a single bond or a $C_{1-6}$ alkylene group which may be substituted; and Y represents a OCO group or a COO group.

2. The electrophotographic photoreceptor according to claim 1, wherein the photosensitive layer is the outermost layer.

3. The electrophotographic photoreceptor according to claim 2, wherein the photosensitive layer includes a charge generation layer and a charge transport layer, and the charge transport layer is the outermost layer.

4. The electrophotographic photoreceptor according to claim 2, wherein the photosensitive layer is a positive-charged single layer.

5. The electrophotographic photoreceptor according to claim 2, wherein the photosensitive layer includes a charge transport layer and a charge generation layer, and the charge generation layer is the outermost layer.

6. The electrophotographic photoreceptor according to claim 1, further comprising a surface protection layer provided on the photosensitive layer, and the surface protection layer is the outermost layer.

7. The electrophotographic photoreceptor according to claim 1, wherein the compound having the structure represented by general formula (I) above has a structure represented by formula (I-1) below:

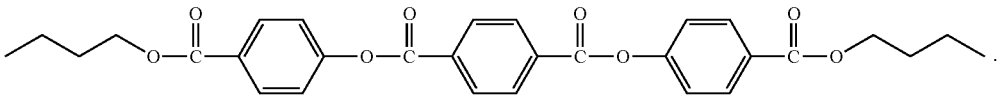

(I-1)

8. The electrophotographic photoreceptor according to claim 1, wherein the compound having the structure represented by general formula (I) is present in an amount of 30 parts by mass or less relative to 100 parts by mass of a resin binder in the layer containing the compound.

9. A method for manufacturing an electrophotographic photoreceptor, comprising:

providing a coating liquid; and applying the coating liquid onto a conductive substrate to form an outermost layer, wherein the coating liquid contains a compound having a structure represented by general formula (I) below:

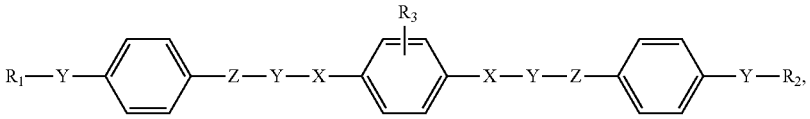

(I)

where $R_1$ and $R_2$ each independently represent a $C_{1-12}$ alkyl group or a $C_{5-12}$ cycloalkyl group; $R_3$ represents a hydrogen atom, a halogen atom, a substituted or unsubstituted $C_{1-6}$ alkyl group, a substituted or unsubstituted $C_{1-6}$ alkoxyl group, a $C_{6-20}$ aryl group or a heterocycle group; X and Z each represent a single bond or a $C_{1-6}$ alkylene group which may be substituted; and Y represents a OCO group or COO group.

10. An electrophotographic device comprising the electrophotographic photoreceptor according to claim 1.

* * * * *